US009328874B2

(12) United States Patent
Demuynck et al.

(10) Patent No.: US 9,328,874 B2
(45) Date of Patent: May 3, 2016

(54) LED LAMP

(71) Applicant: Cree, Inc., Durham, NC (US)

(72) Inventors: Randolph C. Demuynck, Wake Forest, NC (US); Nicholas W. Medendorp, Jr., Raleigh, NC (US); John R. Rowlette, Jr., Raleigh, NC (US); David Power, Morrisville, NC (US); Nick Nguyen, Durham, NC (US); Bart P. Reier, Cary, NC (US); Daniel J. VanEpps, Jr., Apex, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 14/319,066

(22) Filed: Jun. 30, 2014

(65) Prior Publication Data

US 2015/0276140 A1 Oct. 1, 2015

Related U.S. Application Data

(63) Continuation-in-part of application No. 14/224,520, filed on Mar. 25, 2014.

(51) Int. Cl.

| | |
|---|---|
| ***F21V 23/00*** | (2015.01) |
| ***H01R 33/06*** | (2006.01) |
| ***F21K 99/00*** | (2016.01) |
| ***F21V 23/06*** | (2006.01) |
| ***F21V 3/04*** | (2006.01) |
| ***F21V 15/015*** | (2006.01) |
| ***F21V 19/00*** | (2006.01) |
| *F21Y 101/02* | (2006.01) |
| *F21Y 103/00* | (2016.01) |

(52) U.S. Cl.

CPC . *F21K 9/175* (2013.01); *F21V 3/04* (2013.01); *F21V 15/015* (2013.01); *F21V 19/0045* (2013.01); *F21V 23/06* (2013.01); *H01R 33/06* (2013.01); *F21Y 2101/02* (2013.01); *F21Y 2103/003* (2013.01)

(58) Field of Classification Search

CPC ..... F21K 9/10–9/30

See application file for complete search history.

(56) References Cited

U.S. PATENT DOCUMENTS 5,688,042 A 11/1997 Madadi et al.
6,853,151 B2 2/2005 Leong et al.

(Continued)

FOREIGN PATENT DOCUMENTS

CN 201377711 Y 1/2010
CN 102072421 A 5/2011

(Continued)

OTHER PUBLICATIONS

U.S. Appl. No. 29/467,949, filed Sep. 25, 2013.

(Continued)

*Primary Examiner* — Mariceli Santiago

(74) *Attorney, Agent, or Firm* — Dennis J. Williamson; Moore & Van Allen PLLC

(57) ABSTRACT

An LED lamp includes an elongated at least partially optically transmissive enclosure. The LEDs are mounted on an LED board. The enclosure has a support structure for supporting the LED board. The support structure is formed as one-piece with the enclosure and of an optical material. A pair of end caps are secured to the ends of the enclosure using a snap-fit connection. The end caps retain pins for connecting to a light fixture.

22 Claims, 16 Drawing Sheets

(56) References Cited

U.S. PATENT DOCUMENTS

| | | | |
|---|---|---|---|
| 6,860,628 | B2 | 3/2005 | Robertson et al. |
| 6,936,968 | B2 | 8/2005 | Cross et al. |
| 7,048,410 | B2 | 5/2006 | Kutler |
| 7,049,761 | B2 | 5/2006 | Timmermans et al. |
| 7,114,830 | B2 | 10/2006 | Robertson et al. |
| 7,307,391 | B2 | 12/2007 | Shan |
| 7,510,299 | B2 | 3/2009 | Timmermans et al. |
| 7,815,338 | B2 | 10/2010 | Siemiet et al. |
| 7,926,975 | B2 | 4/2011 | Siemiet et al. |
| 7,976,196 | B2 | 7/2011 | Ivey et al. |
| 7,997,770 | B1 | 8/2011 | Meurer |
| 8,058,659 | B2 | 11/2011 | Bisberg |
| 8,093,823 | B1 | 1/2012 | Ivey et al. |
| 8,115,411 | B2 | 2/2012 | Shan |
| 8,118,447 | B2 | 2/2012 | Simon et al. |
| 8,247,985 | B2 | 8/2012 | Timmermans et al. |
| 8,282,247 | B2 | 10/2012 | Ivey et al. |
| 8,324,817 | B2 | 12/2012 | Ivey et al. |
| 8,360,599 | B2 | 1/2013 | Ivey et al. |
| 8,362,710 | B2 | 1/2013 | Langovsky |
| 8,382,327 | B2 | 2/2013 | Timmermans et al. |
| 8,419,223 | B2 | 4/2013 | Withers |
| 8,421,366 | B2 | 4/2013 | Palazzolo et al. |
| 8,449,137 | B2 | 5/2013 | Dassanayake et al. |
| 8,482,212 | B1 | 7/2013 | Ivey et al. |
| 8,573,813 | B2 | 11/2013 | Ivey et al. |
| 8,596,813 | B2 | 12/2013 | Ivey |
| 2002/0060526 | A1 | 5/2002 | Timmermans et al. |
| 2005/0007033 | A1 | 1/2005 | Kan et al. |
| 2010/0201239 | A1* | 8/2010 | Mostoller et al. ..... 313/1 |
| 2011/0103053 | A1 | 5/2011 | Chen et al. |
| 2011/0235320 | A1 | 9/2011 | Cai et al. |
| 2012/0051041 | A1 | 3/2012 | Edmond et al. |
| 2013/0271971 | A1 | 10/2013 | Uemura et al. |
| 2013/0301255 | A1 | 11/2013 | Kim et al. |
| 2014/0029246 | A1 | 1/2014 | Umeda |

FOREIGN PATENT DOCUMENTS

| | | | | |
|---|---|---|---|---|
| EP | 2489929 | A2 | | 8/2012 |
| EP | 2525131 | A1 | | 11/2012 |
| JP | H08162677 | A | | 6/1996 |
| JP | P8-162677 | | | 6/1996 |
| JP | 2007059930 | A | | 3/2007 |
| JP | 2008288183 | A | | 11/2008 |
| JP | 2009117346 | A | | 5/2009 |
| JP | 3153766 | U | | 9/2009 |
| JP | 2009277586 | A | | 11/2009 |
| KR | 2011131908 | A | * | 12/2011 |
| TW | M353300 | U | | 3/2009 |
| WO | 0211250 | A1 | | 2/2002 |
| WO | 2009143047 | A2 | | 11/2009 |
| WO | 2010099755 | A1 | | 9/2010 |
| WO | 2011072580 | A1 | | 6/2011 |

OTHER PUBLICATIONS

U.S. Appl. No. 13/943,152, filed Jul. 16, 2013.

Cree, Inc., International Application No. PCT/US2015/021220, International Search Report and Written Opinion, May 21, 2015.

* cited by examiner 50
171
177
104
106
160
175
196
161
163
194
32
34
30
204
202
167
165
178
173
170
172
164
220

LED LAMP

This application is a continuation-in-part (CIP) of U.S. application Ser. No. 14/224,520, as filed on Mar. 25, 2014, now U.S. Publication No. 2015/0276137, which is incorporated by reference herein in its entirety.

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs, which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

SUMMARY OF THE INVENTION

In some embodiments a lamp comprises an elongated at least partially optically transmissive enclosure having a first end and a second end. At least one LED is in the enclosure operable to emit light through the enclosure when energized through an electrical path. The at least one LED is mounted on an LED board. The enclosure comprises a support structure for supporting the LED board where the support structure is formed as one-piece with the enclosure and is formed of an optical material. An end cap is secured to the enclosure using a snap-fit connection.

The snap-fit connection may comprise a tang on one of the end cap and the enclosure that mates with a detent on the other of the end cap and enclosure. The tang may be formed on the end cap and the detent may be formed on the enclosure. The detent may comprise an aperture that extends through the enclosure. The tang may comprise an angled camming surface that deforms the enclosure when the enclosure is inserted into the end cap. A plurality of tangs may engage a plurality of detents. The end cap may support a first pin where the first pin is in the electrical path; and a first conductor connecting the first pin to the LED board using a first contact coupling. The first conductor may be formed as one piece with the first pin. The first conductor may be resilient. The LED board may comprise a first contact and the first conductor may be deformed to create a bias force between the first conductor and the first contact. A support surface may be positioned adjacent the LED board to a side of the LED board opposite the first conductor. The first pin and the first conductor may be made of a first piece of electrically conductive material that is bent to form the first pin and the first conductor. The end cap may support a second pin and a second conductor connecting the second pin to the LED board using a second contact coupling. The first pin and first conductor and the second pin and the second conductor may be made of stainless steel. The first pin and the second pin may be hollow. The first pin and the first conductor may be retained in the first end cap by a deformable first tang and the second pin and the second conductor may be retained in the first end cap by a deformable second tang. The enclosure and the support structure may be formed of the same optically transmissive material. The support structure may extend for substantially the length of the enclosure. The support structure may comprise a first channel and a second channel for receiving opposite longitudinal edges of the LED board. A portion of the enclosure may extend behind the at least one LED.

In some embodiments, a lamp comprises a plastic, elongated at least partially optically transmissive tubular enclosure. At least one LED is in the enclosure operable to emit light through the enclosure when energized through an electrical path. A first end cap and a second end cap are snap-fit onto the enclosure. Each of the first end cap and the second end cap each support a pin that are coupled to the electrical path.

DETAILED DESCRIPTION

Figure 1:
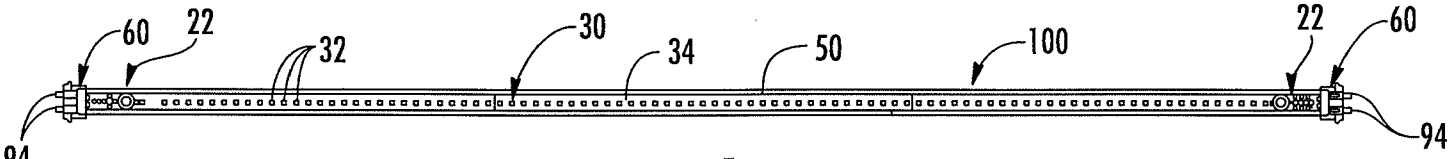
FIG. 1 is a front view showing an embodiment of a LED lamp of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

LEDs and/or LED packages used with an embodiment of the invention and can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be in any of the ways mentioned above. LED devices can be used with phosphorized coatings packaged locally with the LEDs or with a phosphor coating the LED die as previously described. For example, blue-shifted yellow (BSY) LED devices, which typically include a local phosphor, can be used with a red phosphor on or in the optically transmissive enclosure or inner envelope to create substantially white light, or combined with red emitting LED devices in the array to create substantially white light. Such embodiments can produce light with a CRI of at least 90 or at least 95. By use of the term substantially white light, one could be referring to a chromacity diagram including a blackbody 160 locus of points, where the point for the source falls within four, six or ten MacAdam ellipses of any point in the blackbody 160 locus of points. In some embodiments a CRI of 90 or higher may be achieved by providing: a light path that includes spectral notching material (e.g. neodymium or other filters coated on or within the enclosure); and/or high CRI light source/components that may include BSY+R LEDs; blue LEDs with yellow, green, and/or red phosphors (the phosphors may be mixed in a single layer within the component, or one or more of the phosphors may be in separate layers within the component); and/or spectral notching material incorporated with the component. The lamp may generate 100 lumens per Watt or greater.

In some embodiments an antenna may be provided in the bulb for receiving, and/or transmitting, a radio signal or other wireless signal between the lamp and a control system and/or between lamps. The antenna may convert the radio wave to an electronic signal that may be delivered to the lamp electronics for controlling operation of the lamp. The antenna may be mounted on the board and be in communication with the lamp electronics. The antenna may also be used to transmit a signal from the lamp. The antenna may be positioned inside of the enclosure. The antenna may also extend entirely or partially outside of the lamp. Sensors may also be provided on the LED board for detecting, for example, occupancy and/or ambient light. In various embodiments described herein various smart technologies may be incorporated in the lamps as described in the following applications "Solid State Lighting Switches and Fixtures Providing Selectively Linked Dimming and Color Control and Methods of Operating," application Ser. No. 13/295,609, filed Nov. 14, 2011, which is incorporated by reference herein in its entirety; "Master/Slave Arrangement for Lighting Fixture Modules," application Ser. No. 13/782,096, filed Mar. 1, 2013, which is incorporated by reference herein in its entirety; "Lighting Fixture for Automated Grouping," application Ser. No. 13/782,022, filed Mar. 1, 2013, which is incorporated by reference herein in its entirety; "Multi-Agent Intelligent Lighting System," application Ser. No. 13/782,040, filed Mar. 1, 2013, which is incorporated by reference herein in its entirety; "Routing Table Improvements for Wireless Lighting Networks," application Ser. No. 13/782,053, filed Mar. 1, 2013, which is incorporated by reference herein in its entirety; "Commissioning Device for Multi-Node Sensor and Control Networks," application Ser. No. 13/782,068, filed Mar. 1, 2013, which is incorporated by reference herein in its entirety; "Wireless Network Initialization for Lighting Systems," application Ser. No. 13/782,078, filed Mar. 1, 2013, which is incorporated by reference herein in its entirety; "Commissioning for a Lighting Network," application Ser. No. 13/782,131, filed Mar. 1, 2013, which is incorporated by reference herein in its entirety; "Ambient Light Monitoring in a Lighting Fixture," application Ser. No. 13/838,398, filed Mar. 15, 2013, which is incorporated by reference herein in its entirety; "System, Devices and Methods for Controlling One or More Lights," application Ser. No. 14/052,336, filed Oct. 10, 2013, which is incorporated by reference herein in its entirety; and "Enhanced Network Lighting," Application No. 61/932,058, filed Jan. 27, 2014, which is incorporated by reference herein in its entirety.

One embodiment of a LED lamp and suitable LED structure is shown and described in U.S. patent application Ser. No. 12/873,303 entitled "Troffer-Style Fixture" filed on Aug. 31, 2010, which is incorporated by reference herein in its entirety. Example embodiments of interfacing one or more LEDs to AC-output lighting ballasts are described in a related U.S. patent application entitled "LED LIGHTING APPARATUS FOR USE WITH AC-OUTPUT LIGHTING BALLASTS" by Zhang et al., Ser. No. 13/943,455, filed concurrently with this application, the disclosure of which is incorporated by reference herein in its entirety. Example embodiments of interfacing LED strings to fluorescent emergency lighting ballasts are described in a related U.S. patent application entitled "EMERGENCY LIGHTING CONVERSION FOR LED STRINGS" by McBryde et al., Ser. No. 13/943,376, filed concurrently with this application, the disclosure of which is incorporated by reference herein in its entirety. Example embodiments of suitable driver circuitry for use in the lamp of the invention are described in U.S. application Ser. No. 14/055,264 entitled "SOLID-STATE LIGHTING APPARATUS WITH FILIAMENT IMITATION FOR USE WITH FLORESCENT BALLASTS" by Zhang, filed Oct. 16, 2013, the disclosure of which is incorporated by reference herein in its entirety; and U.S. application Ser. No. 14/256,573 entitled "SOLID-STATE LIGHTING APPARATUS WITH FILIAMENT IMITATION FOR USE WITH FLORESCENT BALLASTS" by Zhang, filed Apr. 18, 2014, the disclosure of which is incorporated by reference herein in its entirety. The driver circuitry described herein and as used in the lamp may use the existing fluorescent ballast in some embodiments.

In some embodiments color control is used and RF control circuitry for controlling color may also be used in some embodiments. The lamp electronics may include light control circuitry that controls color temperature of any of the embodiments disclosed herein in accordance with user input such as disclosed in U.S. patent application Ser. No. 14/292,286, filed May 30, 2014, entitled "Lighting Fixture Providing Variable CCT" by Pope et al. which is incorporated by reference herein in its entirety.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Figure 14:
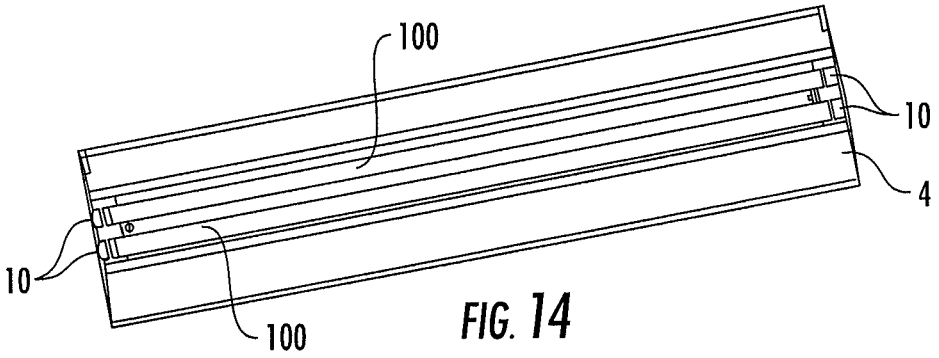
FIGS. 14 and 15 show a troffer housing with the LED lamp of the invention.
Figure 15:
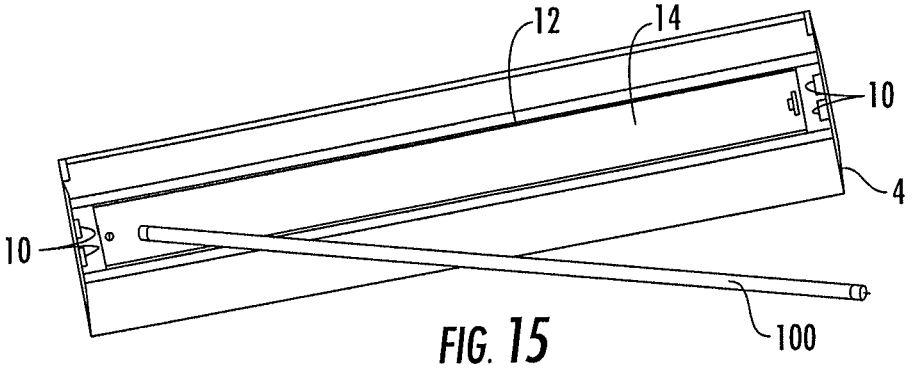
Figure 17:
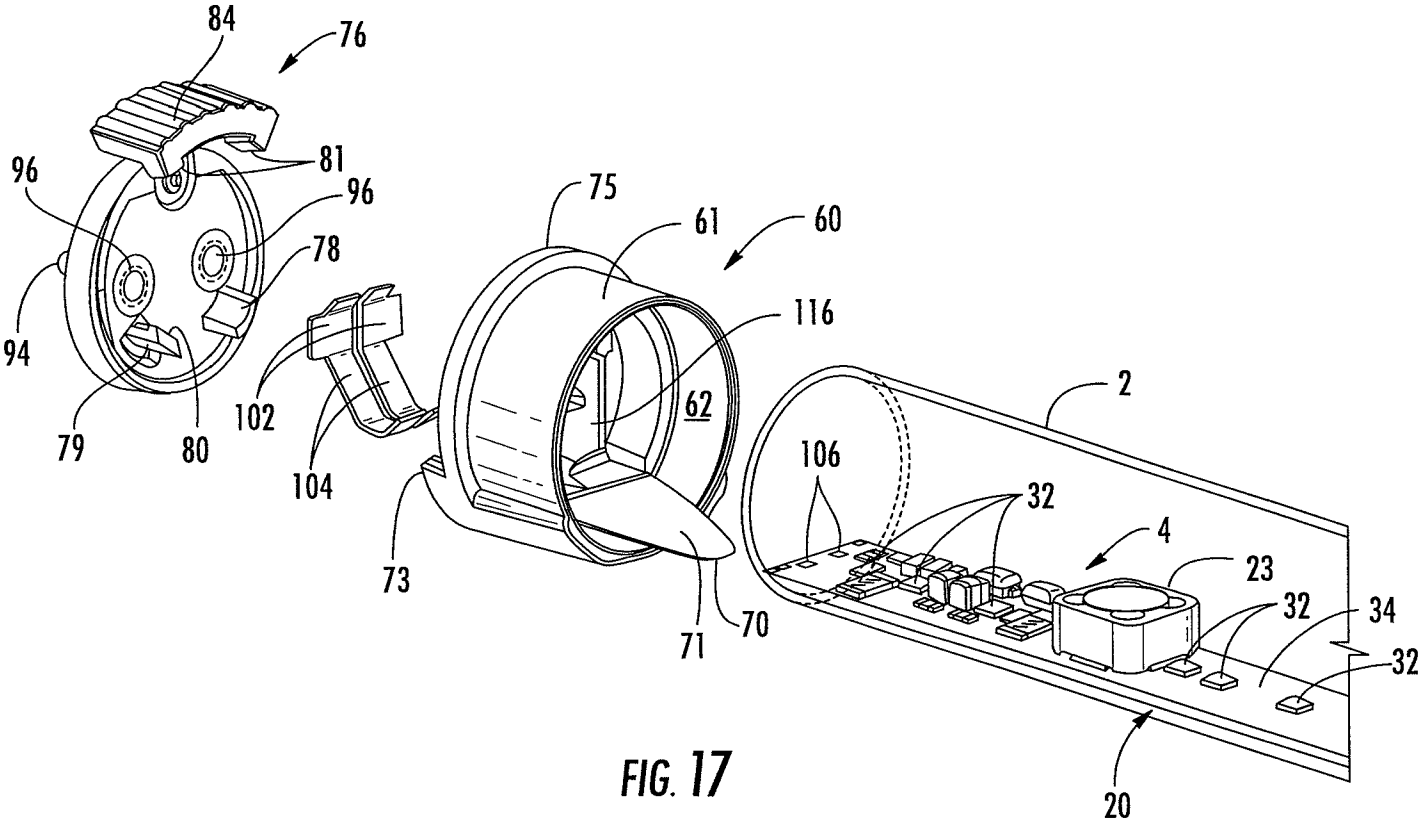
FIG. 17 is an exploded view of the lamp of FIG. 1.
Figure 18:
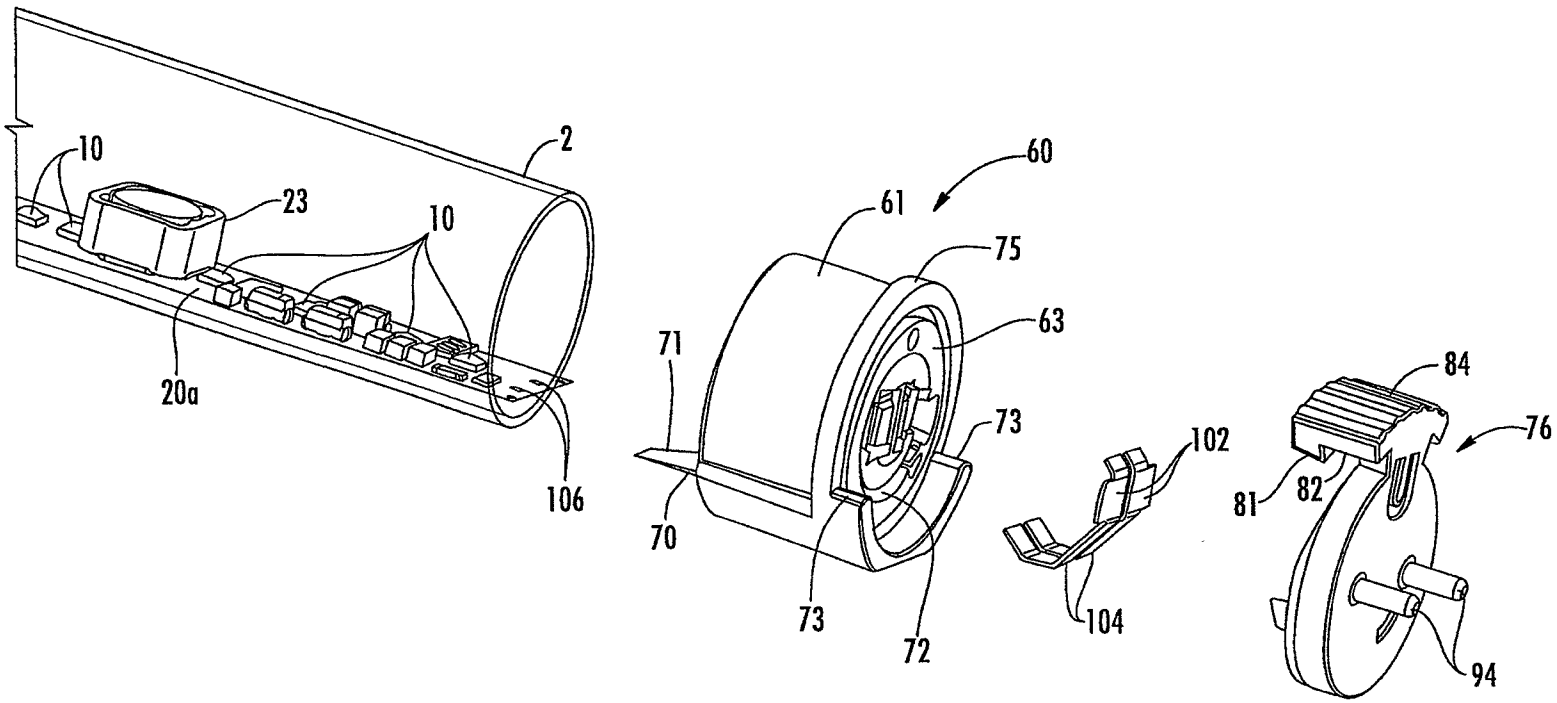
FIG. 18 is another exploded view of the lamp of FIG. 1.

FIGS. 14 and 15 show one embodiment of a traditional fluorescent troffer fixture having a housing 4 that may be recess or flush mounted in a ceiling or other structure. While an embodiment of a fixture is shown, the housing in which the lamp 100 of the invention may be used may comprise a variety of shapes, sizes and configurations. The lamp 100 of the invention may be used in any lighting fixture that uses conventional tombstone connectors. The housing 4 typically supports a ballast and electrical conductors such as wiring that comprise the electrical connection between the lamp's tombstone connectors 10 and a power supply. The power supply may be the electrical grid of a building or other structure or the like. The tombstone connectors 10 connect to two pins formed on each end of the lamp 100 to provide power to the lamp. Typically, the ballast, wiring and other electrical components are retained in a compartment or wire way 12 in the housing 4. The wire way 12 typically comprises a recessed area or trough in the base of the housing 4. The wire way 12 may be covered by a removable wire way cover 14 such that the only exposed electrical components are the UL approved tombstone connectors 10.

Because LED based solid state lamps use less energy, are more durable, operate longer, can be combined in multi-color arrays that can be controlled to deliver virtually any color light, and generally contain no lead or mercury the conversion to, or replacement of fluorescent lighting systems with, LED lighting systems is desired. In some existing replacement lamps the entire fluorescent fixture including the troffer must be replaced. The conversion from a fluorescent light to a solid state LED based light may be time consuming and expensive. In the system of the invention, a traditional fluorescent light may be converted to an LED based solid state lamp quickly and easily by replacing the fluorescent bulb with an LED lamp. The LED lamp fits into the same housing as the fluorescent tube and uses the existing tombstone connectors to provide current to the LED lamp. The LED lamp of the invention allows a traditional fluorescent light to be converted to a solid state LED lamp without requiring specialized tools, equipment or training.

Figure 2:
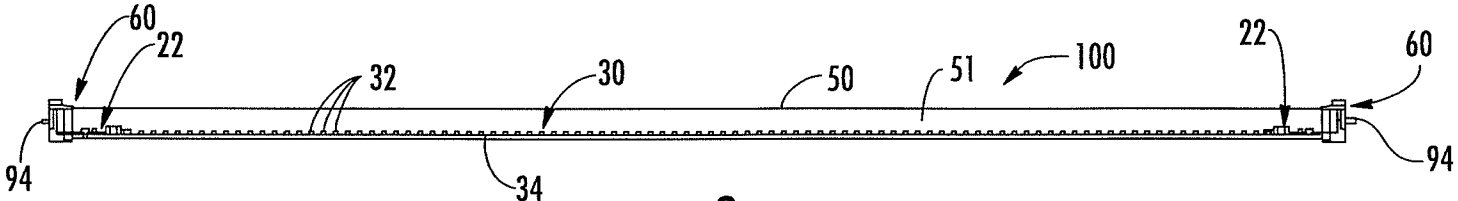
FIG. 2 is a side view of the LED lamp of FIG. 1.
Figure 3:
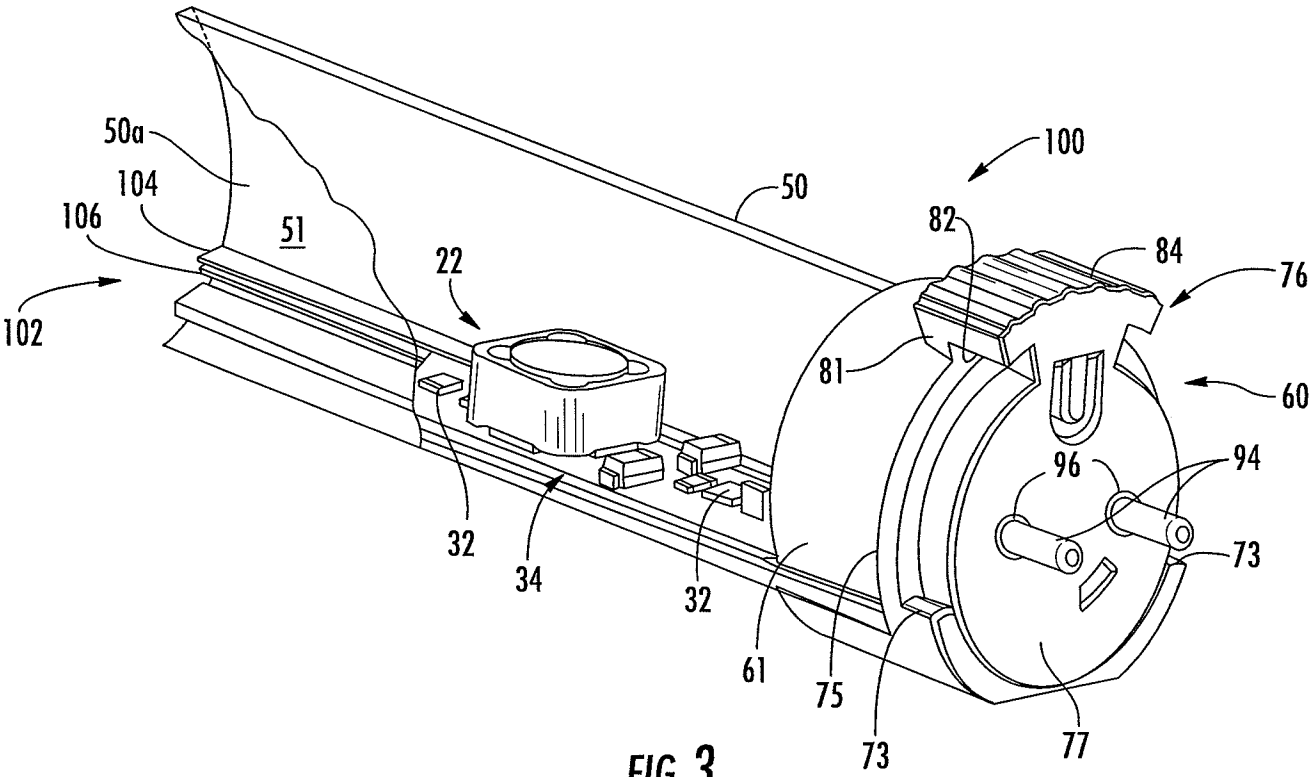
FIG. 3 is a partial perspective view of the LED lamp of FIG. 1.

Referring to FIGS. 1, 2 and 3 the LED lamp 100 comprises an LED assembly 30 that may be supported by and secured within the enclosure 50. The LED assembly 30 may comprise a plurality of LEDs or LED packages 32 that extend the length of, or substantially the length of, the lamp 100 to create a desired light pattern. The LEDs 32 may be arranged such that the light pattern extends the length of, or for a substantial portion of the length of, the lamp 100. While in one embodiment the LEDs 32 extend for substantially the entire length of the lamp, the LEDs 32 may be arranged in other patterns and may extend for less than substantially the entire length of the lamp and may positioned other than down the center of the LED board if desired. For example, the LEDs may be disposed along the edges of the LED board 34 and directed toward the middle of the lamp. The LEDs may be directed into a waveguide.

The LEDs 32 may be mounted on a LED board 34 that provides physical support for the LEDs 32 and provides an electrical path for providing electrical power to the LEDs. The electrical path provides power to the LEDs and may comprise the power source, LED board 34 and intervening lamp electronics 22. The LED board 34 may comprise a PCB using a thin FR4 or a flex circuit. In other embodiments the LED board 34 may comprise a MCPCB, PCB, or lead frame structure. The LED board 34 provides a mounting substrate for the LEDs. The LED board 34 may comprise the electrical components such as a copper layer, traces or the like that form part of the electrical path to the LEDs 32. In other embodiments the electrical conductors to the LEDs 32 may comprise separate conductive elements. In one embodiment the LED board 34 comprises a thermally conductive material, such as a metal layer such as copper, such that heat generated by the LED may be dissipated to the air in the enclosure 50 and be dissipated to the ambient environment by the enclosure 50. In some embodiments the LEDs may be operated at low current and the conductive metal layer of the LED board may be thermally exposed to dissipate enough heat from the LEDs that a heat sink structure is not required. Thermally exposed means that the metal layer is thermally conductive with the air in the enclosure although it may be covered by a thin paint layer or solder mask. The copper, or other metal, layer is thermally exposed in that the cover coat layer is not thermally insulating and heat may be transferred from the copper layer to the surrounding air. In some embodiments, the LED board 34 may comprise more than one physical board where the boards are connected to one another at a connector to provide an electrical path between the individual boards.

The LED board 34 may comprise a flex circuit comprising a flexible layer of a dielectric material such as a polyimide, polyester or other material to which a layer of copper or other electrically conductive material is applied such as by adhesive. Electrical traces are formed in the copper layer to form electrical pads for mounting the electrical components such as LEDs 10 and lamp electronics 22 on the flex circuit and for creating the electrical path between the components. In other embodiments the substrate 20 may comprise a PCB such a PCB FR4 board. A PCB FR4 board comprises a thin layer of copper foil laminated to one side, or both sides, of an FR4 glass epoxy panel. The FR4 copper-clad sheets comprise circuitry etched into copper layers to make the PCB FR4 board. In both the PCB FR4 board and the flex circuit the copper metal layer is supported on a low thermally conductive layer, either a glass epoxy panel or a polyimide layer, where the LEDs are mounted in the enclosure on the LED board without a heat sink.

In some embodiments the LED board 34 may be supported on a separate support member where the support member may be made of a rigid, thermally conductive material such as aluminum that physically supports the LED board. While aluminum may be used, other rigid, thermally conductive materials may be used to form the support member. The LED board 34 may be secured to the support member such as by adhesive, fasteners or the like. While in some embodiments a support member may be used, in other embodiments the LED board 34 may be used without an additional support member. In some embodiments the support member may be made of a thermally conductive material to dissipate heat from the LEDs to the air in the enclosure 50. In some embodiments thermally conductive layers may be provided between the support member and the LED board. For example, thermal adhesive may be used to attach the LED board 34 to the support member. While an additional support member may be used, in some embodiments the LEDs are supported only on the LED board 34 where the LEDs are operated such that sufficient heat is dissipated from the LED board 34 using only the metal in the LED board to achieve steady state operation.

The LEDs 32 may be provided in a wide variety of patterns and may include a wide variety of different types and colors of LEDs to produce light in a wide variety of colors and/or light patterns. One embodiment of a LED lamp and suitable LED structure is shown and described in U.S. patent application Ser. No. 12/873,303 entitled "Troffer-Style Fixture" filed on Aug. 31, 2010, which is incorporated by reference herein in its entirety.

The LED board 34 may be supported by the enclosure 50 such that the LED board 34 and LEDs 32 are supported for the length of the lamp. The enclosure 50 is at least partially optically transmissive such that light emitted from the LEDs 32 is transmitted through the enclosure 50 to the exterior of the lamp. In some embodiments the enclosure 50 is entirely optically transmissive such that light may be emitted from the enclosure over 360 degrees. The enclosure 50 creates a mixing chamber 51 for the light emitted from the LEDs 32 and acts as a lens for the light emitted from the lamp. The light is mixed in the chamber 51 and the optically transmissive enclosure 50 diffuses the light to provide a uniform, diffuse, color mixed light pattern. The enclosure 50 may be extruded of plastic or other material and may be provided with a light diffuser. The light diffuser may be provided by etching, application of a coating or film, by the translucent or semitransparent material of the enclosure material, by forming an irregular surface pattern during formation of the lens or by other method. In the illustrated embodiments the enclosure is shown as clear in order to show the internal components of the lamp; however, the enclosure may comprise a diffuser such that in actual use the internal components may not be visible or may only be partially visible. In other embodiments a first portion of the enclosure may be optically transmissive and a second portion of the enclosure may be optically non-transmissive, such as a reflective surface. In such an embodiment the front of the enclosure 50 may be optically transmissive and the back of the enclosure 50 may be optically non-transmissive such that the back of the enclosure reflects light toward the front of the enclosure.

To facilitate the explanation of the structure of the lamp, the side of the lamp behind the LEDs 32 is referred to as the back of the lamp and the side of the lamp facing the LEDs 32 is referred to as the front of the lamp. In the drawings the bottom portion of the lamp is the back of the lamp and the top portion of the lamp is the front of the lamp. The lamp is shown in the drawings with the LEDs 32 facing upward, but in a typical use the lamp is located in a ceiling fixture where the LEDs 32 face downward. Thus, in a typical use the front of the lamp faces outwardly and downwardly from the fixture and the back of the lamp faces inwardly and upwardly. The horizontal centerline of the lamp is a theoretical plane that is at the center or diameter of the tube and is parallel to the substrate 20. The height of the tube is the vertical distance between the back of the tube and the front of the tube along an axis that is generally at a right angle to the horizontal centerline.

In one embodiment the enclosure 50 may be formed as a tube with a cylindrical outer surface and a generally cylindrical inner surface 50*a* having a round cross-section. The enclosure 50 may have the elongated form factor of a traditional fluorescent tube where the length of the lamp is significantly greater than its diameter. Because the lamp of the invention is intended to be used as a replacement for standard fluorescent tubes the length of the lamp 100 of the invention may also be dimensioned to fit standard fluorescent bulb housings such that the lamp 100 extends between the tombstone connectors 10 with the pins 94 extending parallel to the longitudinal axis of the lamp. In some embodiments, where the lamp 100 of the invention is used to replace a standard 1 inch fluorescent tube the lamp of the invention may have a diameter of approximately 1 inch. The lamp may also be dimensioned to fit into existing fluorescent housings or fixtures as previously described such that the lamp may be made is standard lengths such as 48 inches, 24 inches or the like. While the enclosure is shown as being cylindrical the enclosure may have other shapes and sizes. The enclosure 50 extends substantially the length of the LED assembly 30 to cover the LEDs 32 supported on the LED board 34.

As illustrated in the figures the LED board 34 is arranged in the enclosure 50 such that it is positioned offset from the horizontal centerline of the enclosure 50 such that the LED board is disposed closer to the back of the enclosure 50 than the front of the enclosure. The horizontal centerline L-L is a theoretical plane that is at the center or diameter of the enclosure 50 and that is parallel to the LED board 34. Locating the LED board 34 offset from the centerline L-L of the enclosure 50 towards the back of the enclosure, provides a larger mixing chamber in front of the LEDs and provides for more backlight. In some embodiments the substrate 20 is more than 66% of the height of the tube from the front of the tube, in others embodiments the substrate 20 is more than 75% of the height of the tube from the front of the tube, in other embodiments the substrate 20 is more than 85% of the height of the tube from the front of the tube, and in some embodiments the substrate 20 is more than 90% of the height of the tube from the front of the tube. Another mechanism for effectuating this mixing and increased backlight is to make the width of the substrate 20 narrower relative to the width of the tube. As the width of the substrate is decreased the board will sit lower in the tube, i.e. closer to the back of the tube. A narrower substrate 20 also allows more light to be emitted from the tube as backlight because the narrower substrate blocks less light. Similar to where the board sits in the tube, the width of the tube 2 can also be decreased to less than 50% of the diameter of the tube, less than 33% of the diameter of the tube, less than 25% of the diameter of the tube, or less than 15% of the diameter of the tube. The enclosure 50 is arranged such that to the lateral sides of the LEDs 32 there is no structure to block light emitted by the LEDs. In some embodiments the longitudinal edges of the LED board 34 engage the sides of the enclosure 50. The planar LED board 34 does not obstruct light emitted laterally from the LEDs 32. The enclosure 50, in some embodiments, may be configured such that the width of the enclosure 50 at its widest portion is greater than the width of the LED board 34. As a result, light may be emitted from the enclosure 50 as backlight that is not blocked by the LED board 34. As a result of this arrangement some of the light generated by the LEDs 32 is directed as backlight in a direction behind the plane of the LEDs 32. Some of the light emitted by the LEDs may be emitted directly as backlight while other light emitted by the LEDs may be reflected off of the enclosure 50 and emitted as backlight. The backlight creates a light distribution pattern that is similar to the light distribution pattern of a traditional fluorescent tube. It will be understood that in a traditional fluorescent system the fluorescent tube generates light over 360 degrees. As a result, some of the light generated by the fluorescent tube is reflected from the fixture housing. The backlight generated by the LEDs 32 may be directed toward and reflected from the fixture housing such that the LED lamp of the invention provides a visual appearance similar to the of a fluorescent tube. Such an arrangement provides an LED lighting system that provides a light distribution pattern that is similar to legacy fluorescent tube lights. In some embodiments, the LEDs may be center mounted with greater side emitting optical profiles such as CREE XPQ LEDs. In some embodiments a prismatic lens or parabolic reflectors may be used to create a desired light distribution. Further, combinations of different types of LEDs may be used to create a variety of light patterns and intensities. Moreover, the light distribution can also be effected by the shape of the tube which can be circular oval or other shapes. While the arrangement of the substrate 20 in the enclosure has been described with respect to a generally cylindrical tube 2, the principles also apply to a tube having a different cross-sectional shape. In non-circular cross-sections, the height of the tube may be considered the distance between the front and back of the optically transmissive enclosure and the width of the tube may be considered the distance transverse to the height at the enclosure's widest part.

Referring to FIGS. 3-6, the enclosure 50 may be provided with a support structure 102 where the support structure supports the LED board 34 in the enclosure 50. In one embodiment the support structure 102 comprises supports 104 and 106 that are fixed to the interior surface 50*a* of the enclosure 50 such that the LED board 34 may be retained by the supports 104, 106 in a desired position in the enclosure 50. The supports 104, 106 may be formed as protrusions that extend from the inner wall 50*a* for substantially the length of the enclosure 50 such that supports 104, 106 form relatively narrow elongated flanges that protrude from wall 50*a*. In one embodiment the supports are arranged in opposed pairs such that one longitudinal edge of the LED board 34 is supported by a first pair of supports 104, 106 and the opposite longitudinal edge of the LED board 34 is supported by the opposite pair of supports 104, 106. In one embodiment the supports 104, 106 are formed as one-piece with the enclosure 50 such that the supports 104, 106 and the enclosure 50 are made of the same material and the enclosure 50 and the supports 104, 106 are a one-piece integral assembly. The enclosure 50 may be made of an optically transmissive material such that light may be transmitted through the enclosure. Where the enclosure 50 and the supports 104, 106 are made of one-piece, the supports may be made of the same optically transmissive material as the enclosure. By making the supports 104, 106 of the same material as the enclosure 50 the supports 104, 106 transmit light such that the supports do not block light emitted by the LEDs and are not visible or are only slightly visible during operation of the lamp. The enclosure 50 and the supports 104, 106 may be extruded of a material such as plastic such that the enclosure 50 and the supports 104, 106 may be made in a single extrusion at very low cost and with minimal additional material or processing steps. The enclosure and supports 104, 106 may be made of a material that has a low thermal conductivity such as plastic and the LED board 34 may also be made at least in part of a material having low thermal conductivity such as fiberglass, such as FR4 board, or plastic, such as polymide flex tape.

While in one embodiment the supports 104, 106 and the enclosure 50 are formed simultaneously and are formed as one-piece, in some embodiments the supports 104, 106 may be formed separately and attached to the enclosure 50. The supports 104, 106 may be attached to the enclosure 50 with a permanent attachment mechanism such that the supports 104, 106 and the enclosure 50 form an integrated assembly when assembled. While the use of separate supports 104, 106 may be used, the formation of the enclosure 50 and the supports 104, 106 as one-piece in a single manufacturing operation such as an extrusion process may be the most low cost and efficient process.

While in one embodiment the supports 104, 106 and the enclosure 50 are made of the same optical material, in some embodiments the supports and the enclosure may be made of different optic materials. The supports 104, 106 may be formed separately from the enclosure 50 and attached to form an integrated structure as previously described or the supports 104, 106 and enclosure 50 may be formed using a co-extrusion process or other similar process where a one-piece structure is formed but the supports 104, 106 and enclosure 50 are made of different optic materials.

Figure 16:
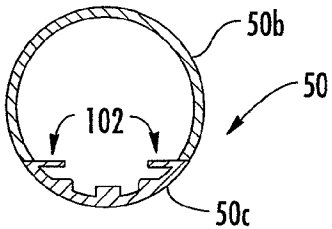
FIG. 16 is a section view showing another embodiment of an enclosure usable in the LED lamp of the invention.

In some embodiments the supports 104, 106 and/or a portion of the enclosure 50 may be made of non-optically transmissive material. Referring to FIG. 16 the enclosure 50 may be formed of an optically transmissive portion 50*b* and a optically non-transmissive portion 50*c*. The optically non-transmissive portion 50*c* may be formed on the back of the lamp.

The back of the lamp may be formed of optically non-transmissive material such as a reflective material such as white plastic while the front of the lamp may be formed of optically transmissive material such as a clear or diffusive material. The reflective back portion 50*c* of the lamp may be used to reflect more light out of the optically transmissive front portion 50*b* of the lamp. In some embodiments the optically transmissive portion 50*b* extends for more than 180 degrees and may extend from near the edges of the LED assembly such that some of the light may be emitted as back light toward the back of the lamp even when the lamp comprises a non-optically transmissive back portion 50*c*. The enclosure 50, formed of an optically transmissive portion and an optically non-transmissive portion, may be made as one-piece using a coextrusion process such that the finished enclosure is one-piece eventhough it comprises more than one material. In some embodiments more than two materials may be used where the materials have different light transmissive properties where all of the materials are made as a one-piece enclosure.

The supports 104, 106 may extend for the length of the enclosure 50 such that the supports support and retain the LED board 34 over its entire length. In an extrusion process the supports 104, 106 and enclosure 50 are extruded together and the extrusion is cut to the desired length to form the enclosure 50. In some embodiments the supports 104, 106 may not extend for the entire length of the enclosure 50 provided that the supports 104, 106 adequately support the LED board. For example the supports may be formed as spaced segments over the length of the enclosure where the spacing between the segments is selected such that the LED board is adequately supported over its length. However, forming segmented supports may be difficult in an extrusion process such that in one preferred embodiment the supports 104, 106 and enclosure 50 are coextensive and are made as an extrusion.

Figure 5:
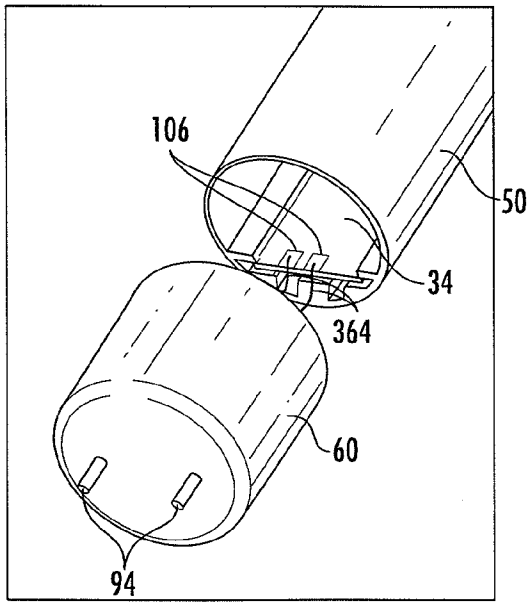
FIG. 5 is a partial perspective view of the LED lamp of FIG. 1.
Figure 6:
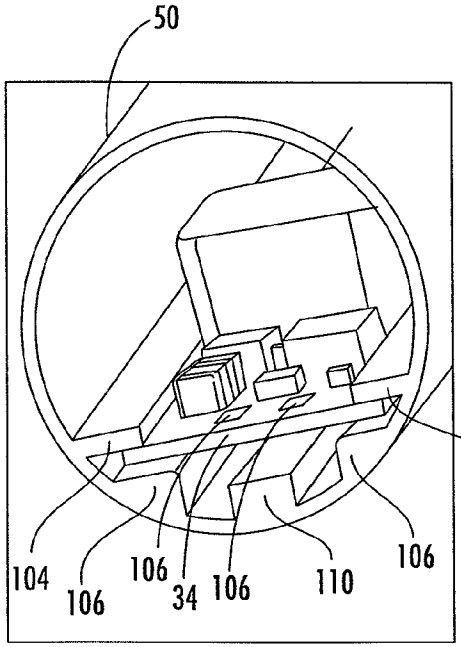
FIG. 6 is another partial perspective view of the LED lamp of FIG. 1.
Figure 4:
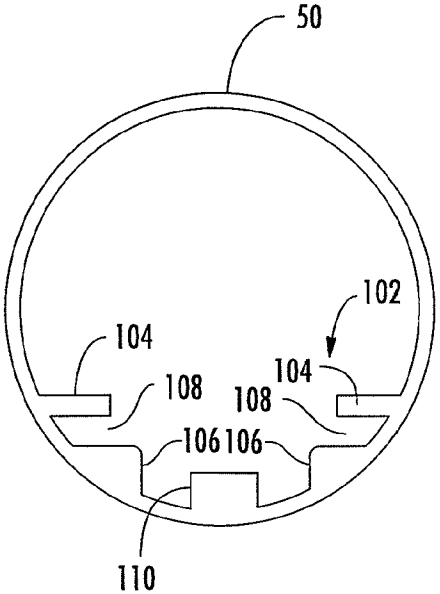
FIG. 4 is an end view of an embodiment of the enclosure in the LED lamp of FIG. 1.

The supports 104, 106 may have a variety of shapes and sizes. Referring to FIGS. 4-6 the supports may comprise opposed front support 104 and back support 106 that define a channel 108 therebetween. The channel 108 may have a shape that generally conforms to the shape of the lateral edge of the LED board 34 such that the edge of the LED board 34 may be inserted in the channel 108. For example, where the LED board 34 is a relatively flat planar member, the channel 108 may be formed as a rectangular slot. Two pairs of supports 104, 106 are located opposite to one another on wall 50*a* to create two opposed channels 108 that receive opposite lateral edges of the LED board 34. In one embodiment the channels 108 may be dimensioned such that the LED board 34 may be easily inserted into the channels 108 from one end of the enclosure 50. In use the lamp is typically supported with the LEDs facing downward such that the LED board 34 rests on and is supported by front supports 104. Because the lamp is typically supported in a stationary manner the LED board may be relatively loosely supported in channels 108. The back supports 106 are used primarily to ensure that the LED board 34 does not become misoriented or slip between the supports 104 as a result of movement or vibrations or during transportation, installation and/or use of the lamp.

While in some embodiments the LED board 34 may be held relatively loosely by the supports 104, 106, in some embodiments the LED board 34 may be more securely held in the enclosure. For example, a friction fit may be created between the LED board 34 and the channels 108. Moreover, additional connection mechanisms may be used to fix the LED board to the enclosure. For example, adhesive may be used to secure the LED board to the enclosure. In other embodiments, a mechanical connection may be used to secure the LED board to the enclosure. For example, tangs may be formed on one of the LED board and enclosure that engage mating detents formed on the other one of the LED board and enclosure. Other connection mechanisms may also be used. While connection mechanisms may be used, the LED board 34 may be loosely held and simply rest on and be supported by the supports 104 as previously described.

In addition to supporting the LED board the support members 104, 106 reinforce the enclosure 50 to make the enclosure more rigid over its length. Because the lamp 100 may be made in relatively long lengths, the additional reinforcement provided by the supports 104, 106 prevents the enclosure 50 from sagging during use, installation and/or transportation. In addition to the LED board supports 104, 106 a reinforcing rib 110 or a plurality of reinforcing ribs may be added that function to reinforce the enclosure 50 but that do not necessarily support the LED board 34. The reinforcing rib 110 reinforces the enclosure 50 to make the enclosure more rigid over its length. Like the support members 104, 106 the reinforcing rib 110 may be made of optical material and may be formed as one-piece with the enclosure 50 as previously described. In other embodiments the reinforcing rib 110 may be formed of reflective material as previously described. In the illustrated embodiment, the reinforcing rib 110 is formed between the channels 108 at the back of the enclosure 50. The reinforcing rib 110 may extend for the length of the enclosure 50. Further, while, as shown in the drawings, the reinforcing rib 110 is spaced from the back LED board, in some embodiments the reinforcing rib 110 may be extended such that it contacts and supports the center of the LED board. Where the reinforcing rib 110 is spaced from the LED board, the reinforcing rib 110 may still provide support and may maintain the position of the LED board relative to the enclosure during shipping, installation and use of the lamp. In some embodiments the LED board is relatively flexible (e.g. a flex circuit) such that the rib 110 may function to keep the board from sagging or vibrating out of position.

Figure 8:
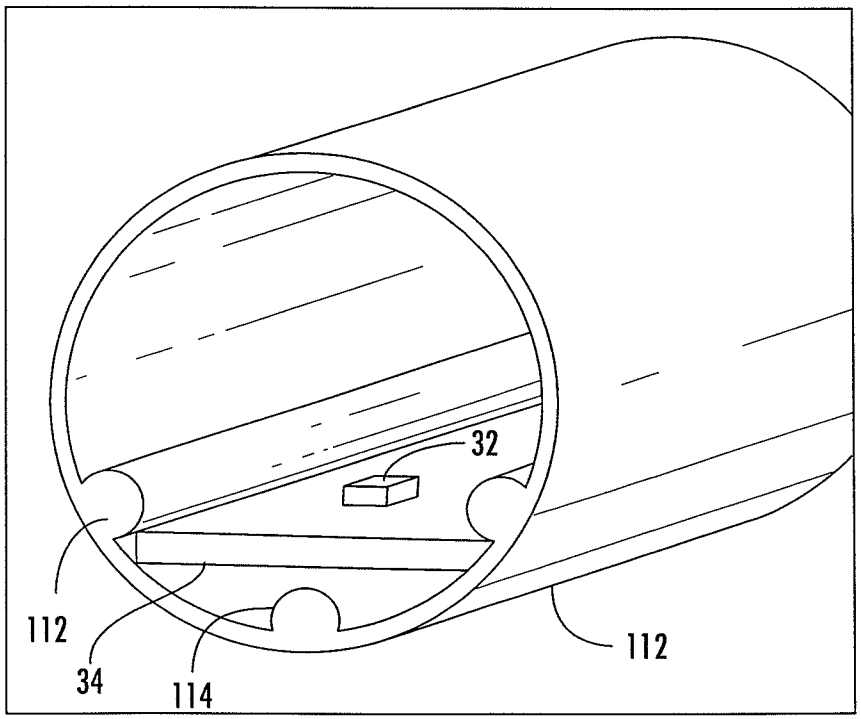
FIG. 8 is a partial perspective view of the LED lamp with the enclosure of FIG. 7.
Figure 7:
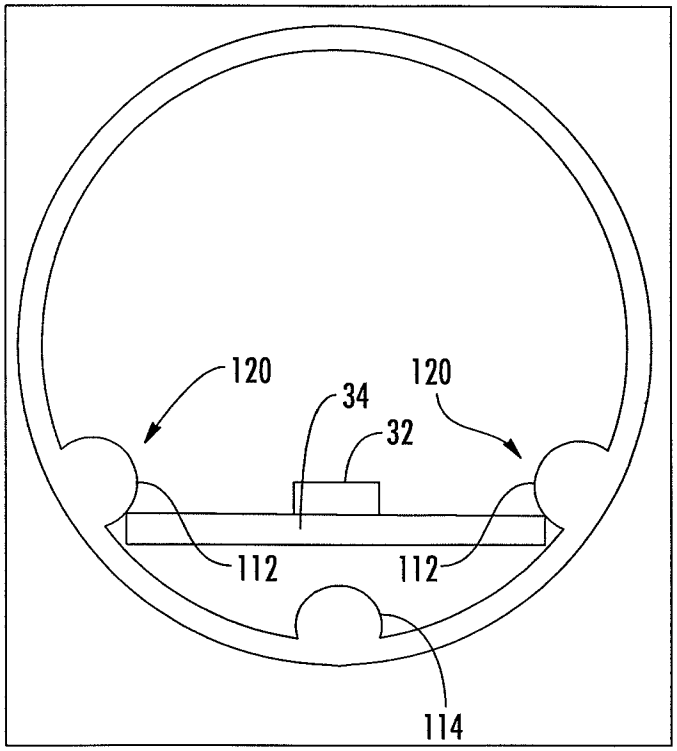
FIG. 7 is an end view of another embodiment of an enclosure usable in the LED lamp of FIG. 1.

Referring to FIGS. 7 and 8, in another embodiment the support structure 102 comprise opposed front supports 112 that extend from the interior wall 50*a* of the enclosure 50 where only front supports are provided. The supports 112 may be dimensioned and positioned such that the LED board 34 is disposed behind the two front supports 112 and is constrained between the two supports 120 and the interior wall of the enclosure 50. A center reinforcing rib 114 extends down the center of the enclosure 50 and functions in the same manner as reinforcing rib 110. The supports 112 are formed as rounded members rather than the rectangular members of FIGS. 4-6. The supports 104, 106 may be formed as rounded members in the embodiment of FIGS. 4-6 and the supports 112 may be formed as rectangular members in the embodiment of FIGS. 7 and 8.

Figure 10:
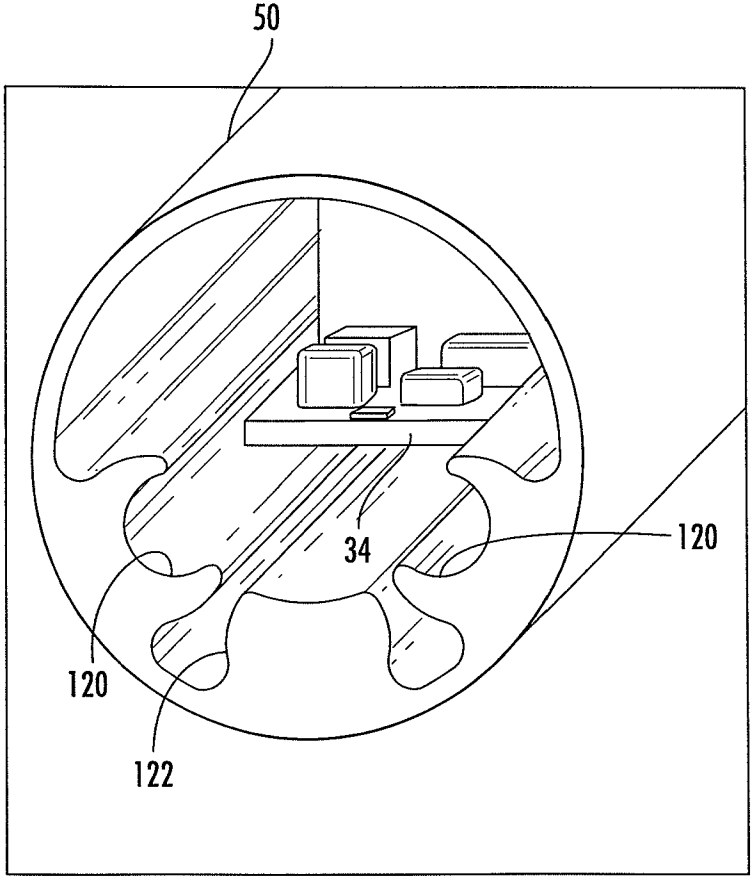
FIG. 10 is a partial perspective view of the LED lamp with the enclosure of FIG. 9.
Figure 9:
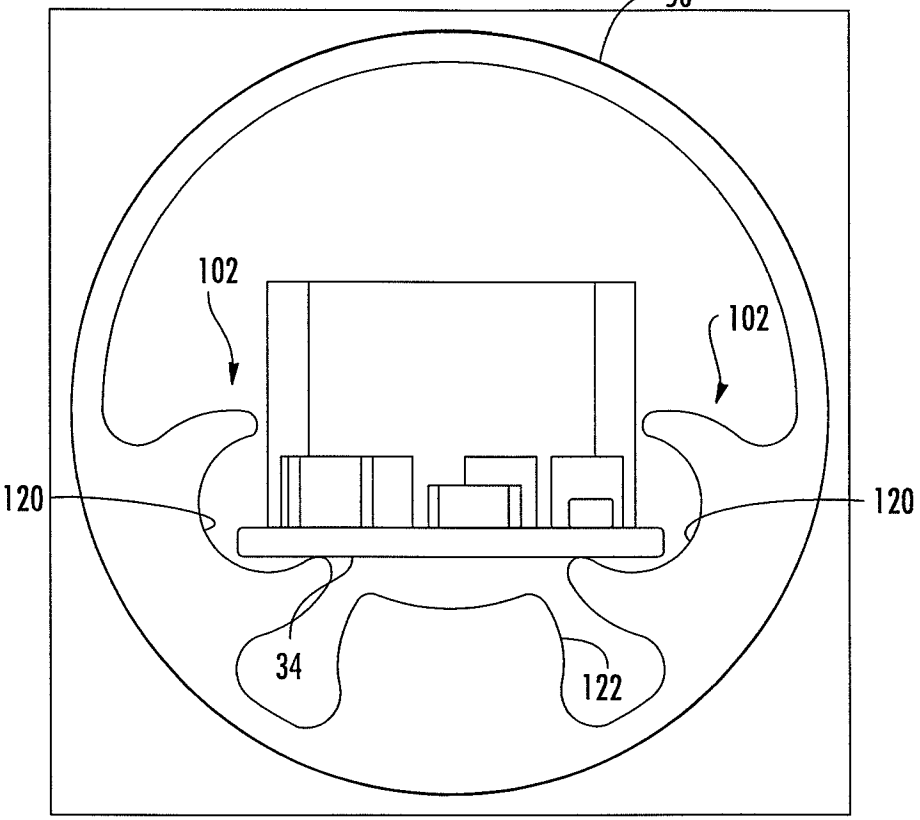
FIG. 9 is an end view of the LED lamp of the invention with another embodiment of an enclosure.

Referring to FIGS. 9 and 10, in another embodiment the support structures 102 are formed as opposed C-channels 120 that extend from the interior wall of the enclosure 50 and are dimensioned to receive the lateral edges of the LED board. An additional reinforcing member 122 may be provided between the C-channels.

To assemble the LED board 34 and enclosure 50 the LED board may be inserted into the enclosure 50 from one end of the enclosure and slid into engagement with the support structures 102. The support structures 102 may have a variety of shapes and sizes other than those disclosed in the figures provided that the support structures retain and support the LED board 34 in the proper position in the enclosure 50.

The LED board 34 may be made of or covered in a reflective material, e.g., MCPET, white optic, or the like, to reflect light from the mixing chamber 51. The entire LED board 34 may be made of or covered in a reflective material or portions of the board may be made of or covered in a reflective material. For example, portions of the LED board that may reflect light may be made of reflective material.

End caps 60 may be provided at the opposite ends of the enclosure 50 to close the interior mixing chamber 51 of LED lamp 100 and to support the electrical connectors 94 for electrically connecting the lamp to the tombstone connectors 10 of the housing. The end caps 60 and enclosure 50 define the mixing chamber 51 for the light.

Figure 11:
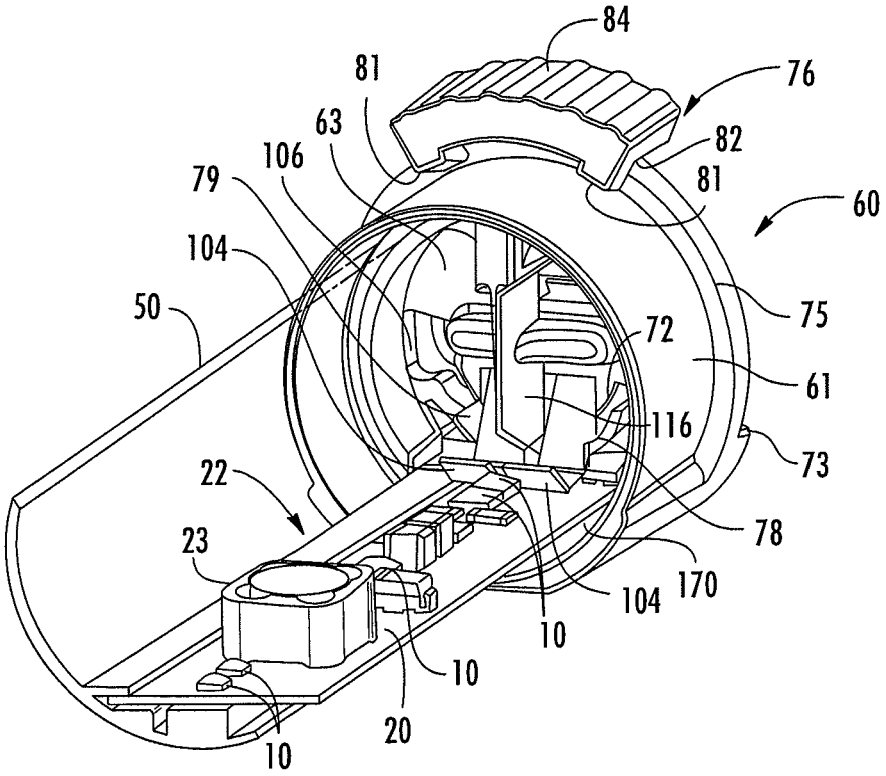
FIG. 11 is another partial perspective view of the LED lamp of FIG. 1.

In some embodiments the end caps 60 may comprise rotating pins 94 such that the pins are rotated relative to the enclosure 50 such that the pins, and not the entire lamp, are rotated during mounting of the lamp in a fixture. The end caps 60 are identical such that the structure and operation of one end cap will be described. Referring to FIGS. 3 and 11, the end cap 60 comprises an internal chamber defined by a side wall 61 and an end wall 63 dimensioned and shaped to closely receive the enclosure 50. The end wall 63 defines a semicircular slot 72 for receiving a portion of the control member 76. The side wall 61 also comprises a bearing surface 75 on which the control member 76 rides and a pair of stops 73 for limiting rotation of the control member 76 relative to the end cap 60 as will be described. The rotating control member 76 is fixed to the end cap 60 such that the control member 76 may rotate relative to the end cap 60 but is otherwise fixed to the end cap 60.

In one embodiment, the rotating control member 76 includes a body 77 that is disposed outside of the end cap, a spacer 78 that extends from the body 77 into the aperture 72, and a stop 79 that also extends from body 77 and into aperture 72. The stop 79 and spacer 78 may slide in aperture 72 such that the control member 76 may rotate relative to the end cap 60. The stop 79 and spacer 78 are provided with locking portions that engage the interior surface of end wall 63 to retain the stop 79 and spacer 78 in the slot 72. The rotating control member 76 may be provided with a protruding area 84 that forms a lever that may be easily accessed by a user to rotate the control member 76 during installation of the lamp as will be described. The protruding area 84 may be provided with a flange or flanges 81 that create a slot or slots 82 for receiving the flanges 81 of the end cap 60 such that the control member 76 is also secured to the end cap 60 by the engagement of the flanges 81 with the bearing surface 75. The protruding area 84 may be knurled to enhance the user's grip on the control member and facilitate the rotation of the control member 76. The control member 76 may also use a detent and tang arrangement between the control member 76 and the end cap 60 to temporarily "lock" the control member relative to the end cap and to provide feedback to the user as to the proper position of the end cap. Other mechanisms for mounting the rotating member to the end caps may also be used.

The control member 76 supports a pair of pins 94 such that rotation of the control member 76 rotates pins 94. The pins 94 are mounted in apertures 96 in the body 77 and are positioned and dimensioned such that the pins 94 are able to mechanically and electrically engage the tombstone connectors 10. In some embodiments a single pin may be used to complete the electrical connection where the second pin may be used only to provide physical support for the lamp in the tombstone connectors. The pins 94 may be insert molded into the control member 76 or the pins 94 may be fixed in the control member 76 using any suitable connection mechanism including a press fit, adhesive, mechanical connector or the like. The pins 94 extend through the control member 76 such that a portion of the pins communicate with the interior of the lamp to create an electrical path to conductors 104. The pins 94 are positioned in the same relative location as the pins on a standard fluorescent tube such that the lamp of the invention may be used in standard fluorescent housings and with standard tombstone connectors.

In one embodiment, the enclosure 50 is slid into the end cap 60 and a snap-fit connection is used to secure the end caps 60 to the enclosure 50. In one embodiment the end cap 60 is provided with tangs or deformable locking members that engage detents or apertures formed on the enclosure. Alternatively, these components may be reversed and the end cap 60 may be provided with the detents or apertures and the enclosure 50 may be provided with the tangs or deformable locking members. The male members on one of the enclosure 50 or end cap 60 engage the female members on the other of the enclosure 50 or end cap 60 when the enclosure is inserted into the end cap 60. The end caps 60 and/or the enclosure 50 may be slightly resiliently deformable such that as the enclosure 50 is inserted into the end cap 60 the components deform relative to one another to allow a snap-fit connection to be made. These members may be dimensioned such that a friction fit is created between the enclosure and the end caps to further secure the end caps 60 to the enclosure. Other arrangements of a snap-fit connector may be used. While use of a snap-fit connector provides a simple assembly method that does not require additional tools, assembly steps or fasteners, the end caps 60 may be connected to the enclosure 50 using other connection mechanisms such as separate fasteners, adhesive, or the like.

Electrical conductors 104 are electrically coupled to the pins 94 and to electrical contacts 106 formed on the LED board 34 to complete the electrical path between the pins 94 and the LED assembly 4. In some embodiments, the conductors 104 may comprise wires, ribbons or the like that are soldered or otherwise electrically coupled to the pins 94 and to contacts 106 on the LED board 34. In one embodiment the conductors 104 may comprise resilient members that may be biased into engagement with contacts 106 on the LED board 34 as shown in FIG. 11. The conductors 104 comprise resilient members made of an electrically conductive material such as copper. Each conductor has a first end supported in slots 100 formed in the end wall 63 of the end cap 60 such that contact pads 102 are created on the exterior of the end cap. The opposite ends of the conductors 104 extend into the internal space of the end cap 60 where the conductors 104 make contact with electrical contacts 106 on the LED board 34. The conductors 104 are configured and supported such that the free ends of the conductors 104 are biased into engagement with the contacts 106. An insulator 116 may be provided between the conductors 104 to electrically insulate the conductors from one another. An electrical path is created between the pins 94 and the LED board 34 to provide both sides of critical current to the LED assembly when the pins 94 are electrically coupled with conductors 104 and the conductors 104 are biased into engagement with electrical contacts 106 on the substrate 20. The pins 94 may be in continuous contact with conductors 104 or the electrical connection between the pins 94 and the conductors 104 may be made when the control member is rotated.

To retrofit an existing fluorescent fixture, the existing fluorescent tubes 213 are removed from the fixture housing. The control members 76 are positioned in the operational position of FIG. 13 such that the pins 94 are aligned in a plane that is perpendicular to the substrate 20. In a typical ceiling mount fixture the control member 76 is positioned such that the pins 94 are aligned generally vertically and the LEDs 10 face downwardly. The lamp 1 is inserted into the housing 4 such that the pins 94 are inserted into the linear slots 200 of the tombstone connectors 210. In this position the pins 94 are not electrically coupled to the pads 102 of conductors 104 such that no electrical path is created between the pins and the conductors. Once the lamp 100 is properly positioned in the housing and the pins 94 are seated in the tombstone connectors 210, the control member 76 is rotated 90 degrees relative to the tube 2 by the user to rotate the control member 76 and pins.m The pins 94 rotate in the in the circular slots of the tombstone connector. The tube remains stationary during the rotation of the pins. The pins 94 are rotated to engage the existing electrical contacts in the tombstone connectors 210. As the pins 94 rotate relative to the end caps 60 the pins 94 are brought into contact with the pads 102 formed on the electrical conductors 104 to complete the electrical path between the tombstone connectors and the LEDs 10. In this manner the rotation of the control member acts as a switch to disconnect the power supply from the pins until the control member 76 is rotated and the pins 94 are brought into contact with the pads 102 formed on the electrical conductors 104 to complete the electrical path. Such a switch function may be important for safety considerations. For example, United Laboratories (UL) has a test for leakage current for such lamps. It will be appreciated that in some installations of a linear lamp, the user may insert the pins sequentially such that the first set of pins on one end of the lamp are inserted into the tombstone connector (and to the source of power) while the second set of pins on the opposite end of the lamp are still exposed, outside of the second tombstone connector. The user may then insert the second set of pins into the second tombstone connector. In such a situation leakage current in the second set of pins may present a shock hazard to the user. Using the control member 76 as a switch to disconnect the power source from the lamp until both sets of pins are seated in their respective tombstone connector eliminates or minimizes the shock hazard from leakage current in the lamp.

With the rotary end cap and pins described above, the lamp is held stationary while the control member 76 and pins 94 are rotated to electrically and mechanically secure the lamp 100 to the tombstone connectors 10. To install the lamp in a fixture housing the control members 76 are rotated relative to the enclosure such that the pins 94 are aligned along a line perpendicular to the LED board 34. In a typical ceiling mount fixture the control member 76 is rotated such that the pins are aligned generally vertically. The lamp 100 is inserted into the housing 4 such that the pins 94 are inserted into the linear slot of the tombstone connectors 10. Once the lamp 100 is properly positioned in the housing and the pins 94 are seated in the tombstone connectors 10, the control member 76 is rotated relative to the enclosure 50 by the user to rotate the pins 94 ninety degrees. The pins 94 rotate in the in the circular slots of the tombstone connectors 10. The enclosure 50 remains stationary during the rotation of the pins 94. The pins 94 are rotated to engage the existing electrical contacts in the tombstone connectors 10.

Figure 12:
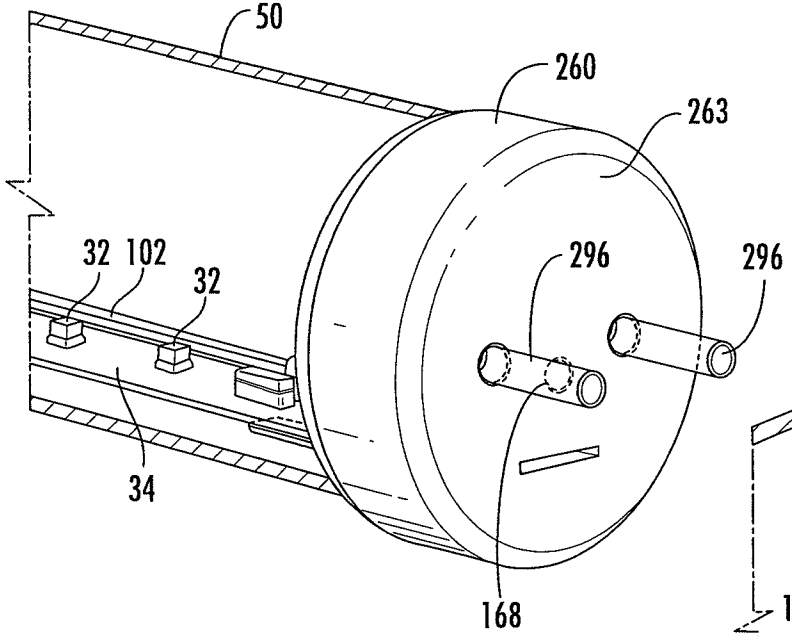
FIG. 12 is a partial perspective view of another embodiment of the LED lamp of the invention.
Figure 31:
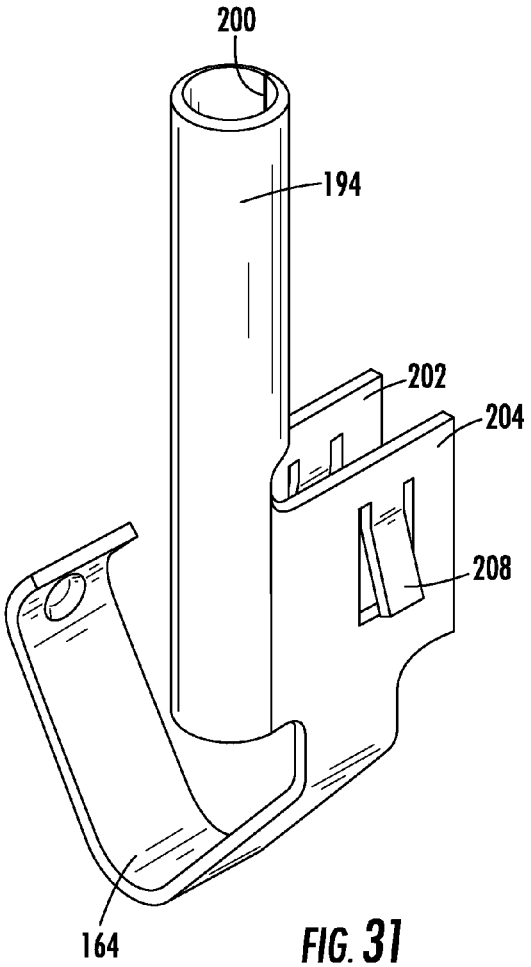

Referring to FIGS. 12 and 31, in an alternate embodiment the LED board 34 may be formed as previously described but with an engagement structure 150 mounted to each end of the LED board 34 to mount the LED board 34 to the end caps 60. The engagement structure 150 may comprise two clips 152, one of the clips 152 being secured to each end of the LED board 34. The clips 152 may be secured to the LED board 34 by adhesive provided such an attachment does not fail under the operating conditions of the lamp. In some embodiments the clips 152 may be secured to the LED board 34 by a mechanical connector such as a rivet that engages all of the layers of the LED board 34. A reinforcement member may be attached to the LED board 34 to further structurally reinforce the connection.

An embodiment of an end cap 260 comprises a conductor 164 that comprises resilient, electrically conductive material that is supported in the end cap 260 such that one end of the conductor 164 may be electrically coupled to pins 296. The opposite end of the conductor 164 extends into interior of the end cap 260. The conductor 164 is supported against the end cap 160 such that the free end of the conductor 164 extends adjacent to the clip 152 when the end cap 160 is mounted on the enclosure 50. The conductors 164 are configured such that they may be resiliently deformed to engage the clip 152. The deformed conductors 164 are configured to exert a force on the clip 152 sufficient to place the LED board 34 under tension. It will be appreciated that the conductors on the two end caps exert a pulling force on the LED board 34 to place the LED board under tension. In some embodiments, it has been found that a two pound tension force on the LED board 34 is sufficient to keep the substrate from sagging or vibrating during use. For a 48 inch lamp a 2 lb force applied to a flex circuit maintains the sagging or deflection of a flex circuit to less than 1 mm. For a 48 inch lamp a 3 lb force applied to a flex circuit maintains the sagging or deflection of a flex circuit to approximately 0.5 mm. The conductors 164 may be formed with hooks 166 at the distal ends thereof that engage the clips 152 to exert the tensile force on the LED board 34. The clip 152 is electrically coupled to the copper layer of the flex circuit such that engagement of the conductors 164 with the clips 152 forms part of the electrical path between the pins 94 and the LED board 34.

In the illustrated embodiment a single conductor 164 and clip 152 are provided where critical current is provided to the LED board through a single electrical contact. In other embodiments, two clips 152 may be used that connect to two conductors 164 such as is shown in the embodiment of FIG. 11. Further, in the embodiment of FIG. 11 a single electrical conductor 104 and contact 106 may be used to provide the critical current to the LEDS such as shown in FIG. 13.

To engage the conductors 164 with the clips 152, a hole 168 is formed in the wall 263 of the end cap 260. An elongated tool may be inserted into the hole 168 to push the conductor 164 to a deformed position where the LED board 34 may be inserted under the conductor 164 as the end cap 260 is inserted onto the enclosure 50. When the tool is removed, the conductor 164 returns to the undeformed state where the hook 166 is biased into engagement with the clip 152 such that the conductor 164 exerts a tension force on the LED board 34 sufficient to suspend the LED board 34 in the enclosure 50 with minimum sag or vibration. The LED board 34 is supported between the end caps 60 at either end of the tube 2 such that the substrate 20 is pulled between the end caps 60 and is supported under tension.

A ramp 170 may extend from the end cap 260 and be inserted underneath the LED board 34 when the end cap 260 is inserted over the enclosure 50. The ramp 170 supports the end of the LED board 34 to ensure that the LED board is properly positioned and supported to make the electrical connection with the conductor 162. A similar ramp may be used to support the end of LED board 34 in the embodiment of FIG. 11.

Figure 13:
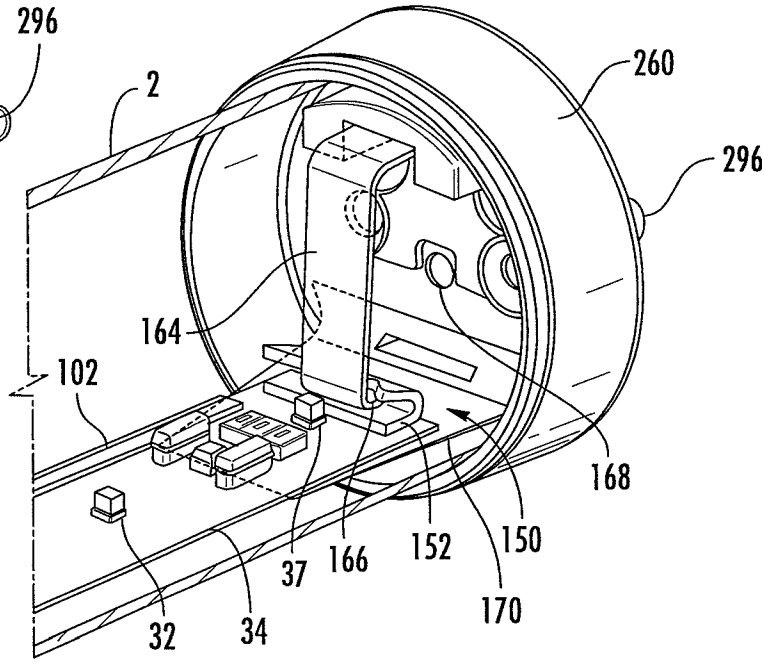
FIG. 13 is another partial perspective view of the LED lamp of FIG. 12.

In the embodiment of FIGS. 12 and 13, the end caps 260 are fixed to the enclosure 50 and the pins 294 do not rotate relative to the enclosure 50. In such a design the entire lamp is rotated in the same manner as a traditional fluorescent tube to insert the pins 294 in the tombstone connectors 10. The stationary pins may be provided with the electrical connector as described with reference to FIGS. 3 and 11 while the rotating pins may be provided with the electrical connector as shown in FIGS. 12 and 13.

In another embodiment the pins 94, 294 may be electrically coupled to the LED board 34 using conductors that are soldered or otherwise fixed to the LED board contracts 106 and that are electrically coupled to the pins 294. In one embodiment the conductors may comprise wires 364 as shown in FIG. 5. The wires 364 are electrically coupled to the pins 94, 294 and are soldered or otherwise electrically coupled to the electrical contacts 106 on the LED board 34. After the wire is connected to the LED board, the end cap may be slid over the enclosure to complete the lamp.

To assemble the lamp of the invention, an LED board 34 is populated with LEDs 32. The LED board 34 is inserted into the enclosure 50 such that the LED board 34 is supported by the support elements 102 as previously described. The electrical connection between the pins in the end caps and the LED board are completed and the end caps are mounted on the enclosure to complete the lamp.

An alternate embodiment of the lamp is shown in FIGS. 19 through 32 Referring to FIGS. 19-22, the enclosure 50 may be provided with a support structure 102 similar to the support structure of FIGS. 3-6 where the support structure 102 supports the LED board 34 in the enclosure 50. In one embodiment the support structure 102 comprises supports 104 and 106 that are fixed to the interior surface 50*a* of the enclosure 50 such that the LED board 34 may be retained by the supports 104, 106 in a desired position in the enclosure 50. The supports 104, 106 may be formed as protrusions that extend from the inner wall 50*a* for substantially the length of the enclosure 50 such that supports 104, 106 form relatively narrow elongated flanges that protrude from wall 50*a*. In one embodiment the supports are arranged in opposed pairs such that one longitudinal edge of the LED board 34 is supported by a first pair of supports 104, 106 and the opposite longitudinal edge of the LED board 34 is supported by the opposite pair of supports 104, 106. The supports may comprise an opposed front support 104 and back support 106 that define a channel 108 therebetween. The channel 108 may have a shape that generally conforms to the shape of the lateral edge of the LED board 34 such that the edge of the LED board 34 may be inserted in the channel 108 as previously described. Centering spacers 107 may be formed in the channels formed by supports 104, 106 that center the LED board in the enclosure 50. In one embodiment the supports 104, 106 and spacers 107 are formed as one-piece with the enclosure 50 such that the supports 104, 106 and spacers 107 and the enclosure 50 are made of the same material and the enclosure 50 and the supports 104, 106 and spacers 107 are a one-piece integral assembly as previously described. While in one embodiment the supports 104, 106 and spacers 107 and the enclosure 50 are formed simultaneously and are formed as one-piece, in some embodiments the supports 104, 106 and spacers 107 may be formed separately and attached to the enclosure 50 as previously described. While in one embodiment the supports 104, 106, spacer 107 and the enclosure 50 are made of the same optical material, in some embodiments the supports and the enclosure may be made of different optic materials as previously described. The back of the lamp may be formed of optically non-transmissive material such as a reflective material such as white plastic while the front of the lamp may be formed of optically transmissive material such as a clear or diffusive material as previously described. The supports 104, 106 and spacers 107 may extend for the length of the enclosure 50 such that the supports support and retain the LED board 34 over its entire length while in some embodiments the supports 104, 106 and spacers 107 may not extend for the entire length of the enclosure 50 provided that the supports 104, 106 adequately support the LED board.

End caps 160 may be provided at the opposite ends of the enclosure 50 to close the interior mixing chamber 51 of LED lamp 100 and to support the electrical connectors 194 for electrically connecting the lamp to the tombstone connectors 10 of the housing. The end caps 160 and enclosure 50 define the mixing chamber 51 for the light. To insert the lamp into an existing fixture the entire lamp may be rotated in the same manner as a traditional fluorescent tube to insert the pins 94 in the tombstone connectors.

The end caps 160 are identical such that the structure and operation of one end cap will be described. Referring to FIGS. 20 and 23 through 25, the end cap 160 comprises an internal chamber defined by a side wall 161 and an end wall 163 configured to closely receive the enclosure 50. The end wall 163 supports a pair of pins 194 in apertures 196. The pins 194 are positioned and dimensioned to mechanically and electrically engage the traditional tombstone connectors found in a fluorescent fixture. In some embodiments a single pin 194 may be used to complete the electrical connection where the second pin 194 may be used only to provide physical support for the lamp in the tombstone connectors. The pins 194 may be fixed in the end caps 160 using any suitable connection mechanism including a press fit, adhesive, mechanical connector, insert molding or the like; however, in one embodiment a snap-fit connection is used as will hereinafter be described. The pins 194 extend through the end wall 163 such that a portion of the pins communicate with the interior of the lamp to create electrical conductors 164.

Figure 26:
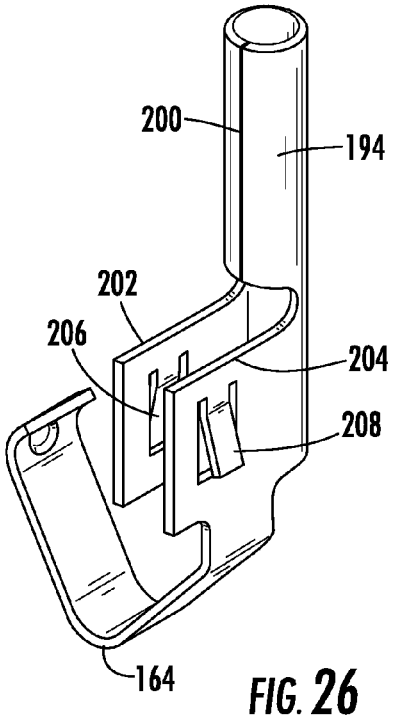
FIGS. 26-31 are various views showing the pin and electrical connector used in the LED lamp of FIG. 19.
Figure 27:
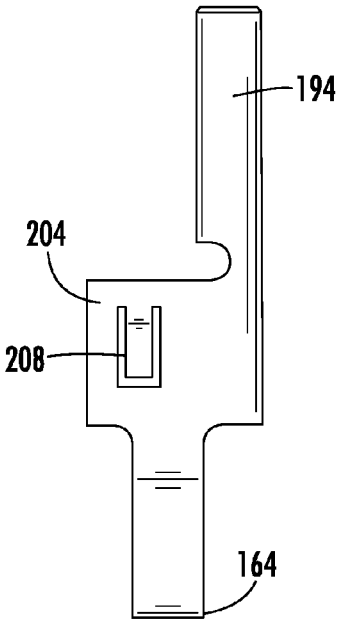
Figure 28:
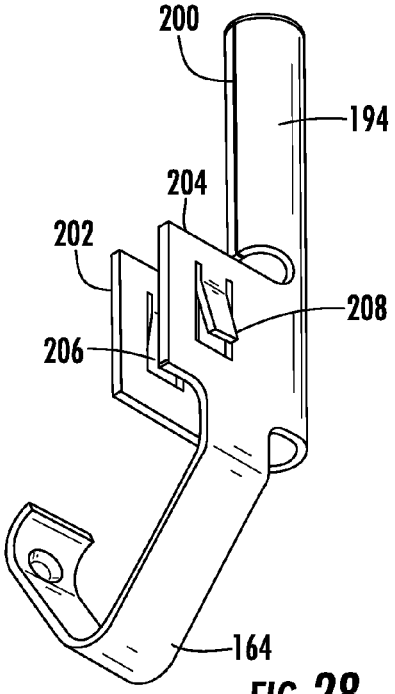
Figure 29:
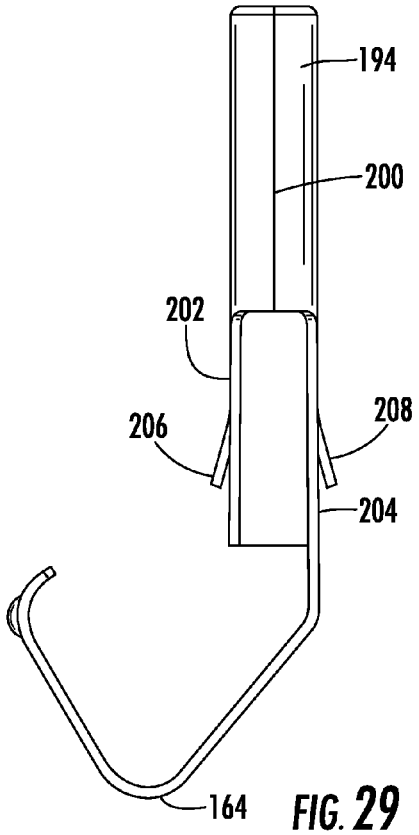
Figure 30:
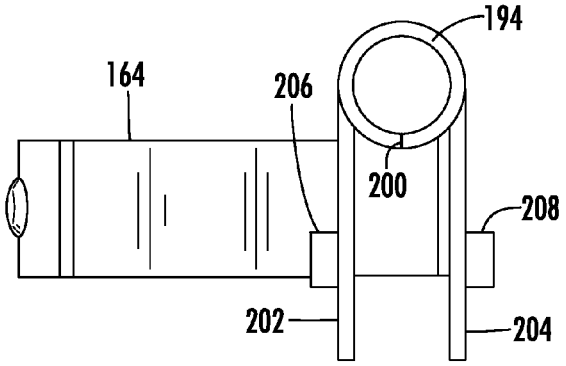

The electrical conductors 164 are electrically coupled to the pins 194 and to electrical contacts 106 formed on the LED board 34 to complete the electrical path between the pins 194 and the LED assembly 30. Electrical conductors 164 are electrically coupled between the pins 194 and to electrical contacts 106 formed on the LED board 34 to complete the electrical path between the pins 194 and the LED assembly 30. In one embodiment, the conductors 164 and the pins 194 are formed of a single piece of conductive material where the pin 194 and its related conductor 164 are a single one-piece member. One embodiment of the one-piece pin 194 and conductor 164 is shown in FIGS. 26-31. FIGS. 26-30 show the right hand pin/conductor assembly and FIG. 31 shows the left hand pin/conductor. The pin/conductor assemblies shown in FIGS. 26 and 31 are mirror images of one another such that specific reference will be made to the pin/conductor assembly of FIGS. 26-30. While left hand and right hand pin/conductors are used in the illustrated embodiment in some embodiments the two pin/conductors in each end cap 160 may be identical.

Referring to FIGS. 26-30 each pin/conductor assembly may be made of a single piece of electrically conductive material that is rolled and/or stamped to create the pin/conductor assemblies used in the end caps 160. Specifically the pin/conductor assembly may be made of stainless steel to closely match the galvanic properties of the brass tombstone connectors and the tin contacts 106 on the LED assembly 30. A flat piece of conductive material may be rolled to create the pin 194. Because the pin 194 is rolled, the pin 194 is hollow and a seam 200 is formed between the two ends of the rolled material. A pair of opposed flanges 202, 204 are also formed at one end of the pin 194. Flange 202 is formed with a barb or tang 206 that extends outwardly from the flange 202 and flange 204 is formed with a barb or tang 208 that extends outwardly from the flange 204. The tangs may be stamped into the flanges before the material is rolled. A conductor 164 extends from one of the flanges as is bent to form a contact that may be biased into engagement with the contacts 106 on the LED board 34. The conductor 164 may extend from either flange 202 or 204 or from the pin 194.

Figure 20:
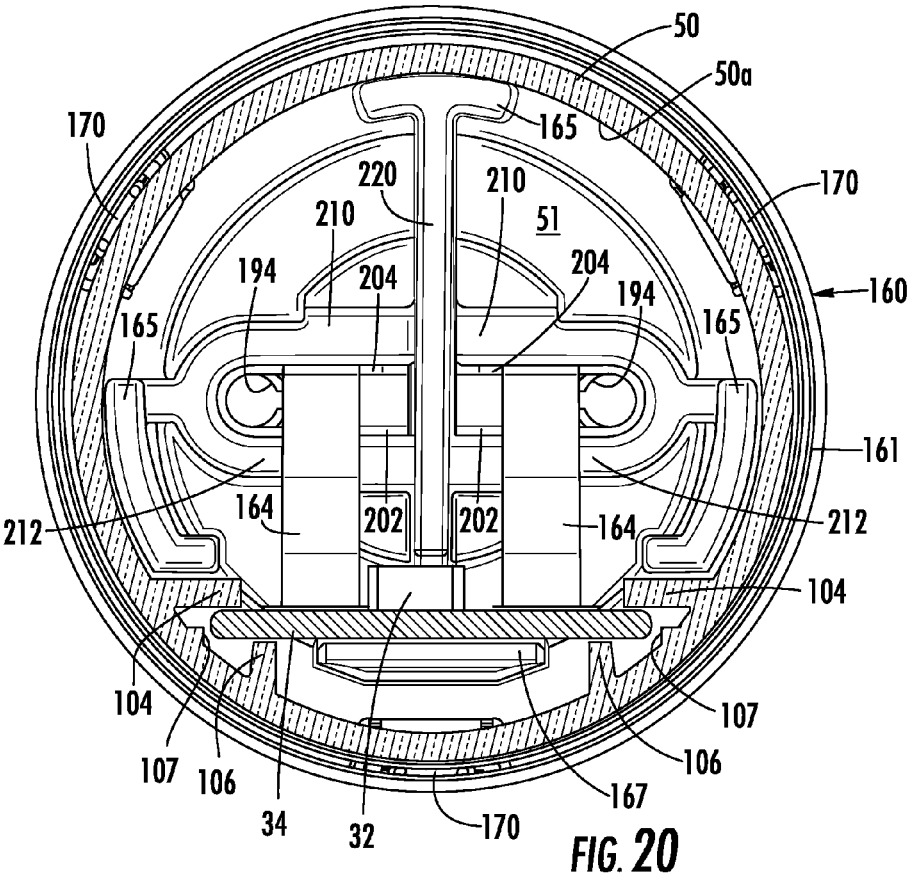
FIG. 20 is a section view taken along line 20-20 of FIG. 19.
Figure 19:
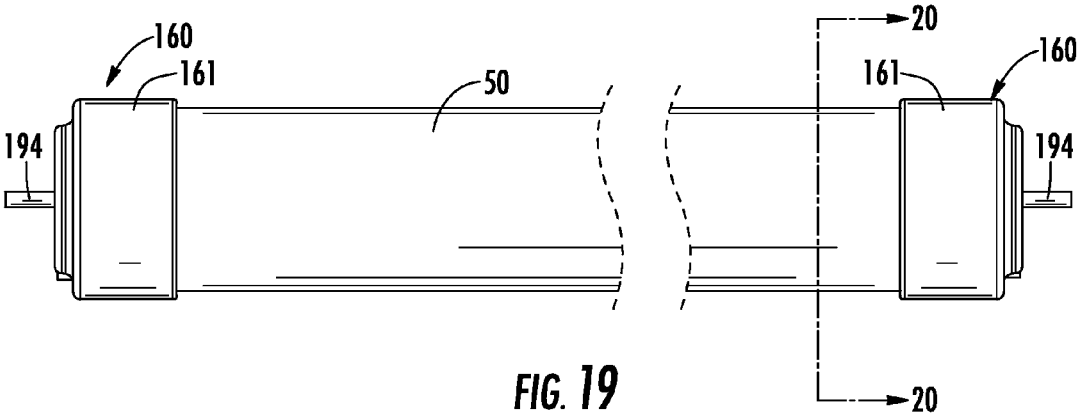
FIG. 19 is a side view of an alternate embodiment of the lamp of the invention.
Figure 21:
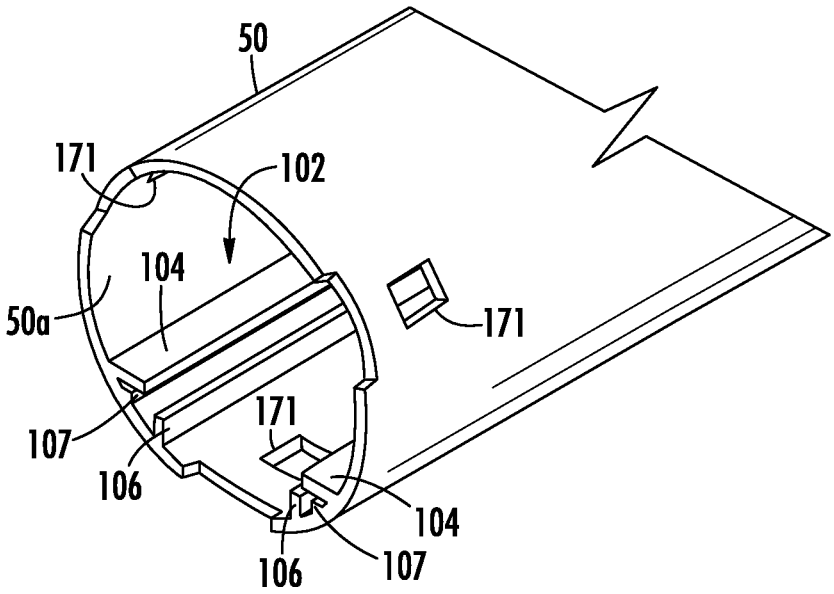
FIG. 21 is a partial perspective view of an embodiment of the enclosure of the LED lamp of FIG. 19.
Figure 22:
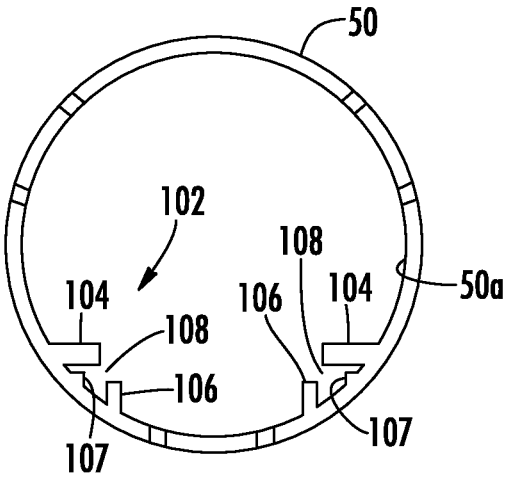
FIG. 22 is an end view of the enclosure of FIG. 21.
Figures 23, 24, 25:
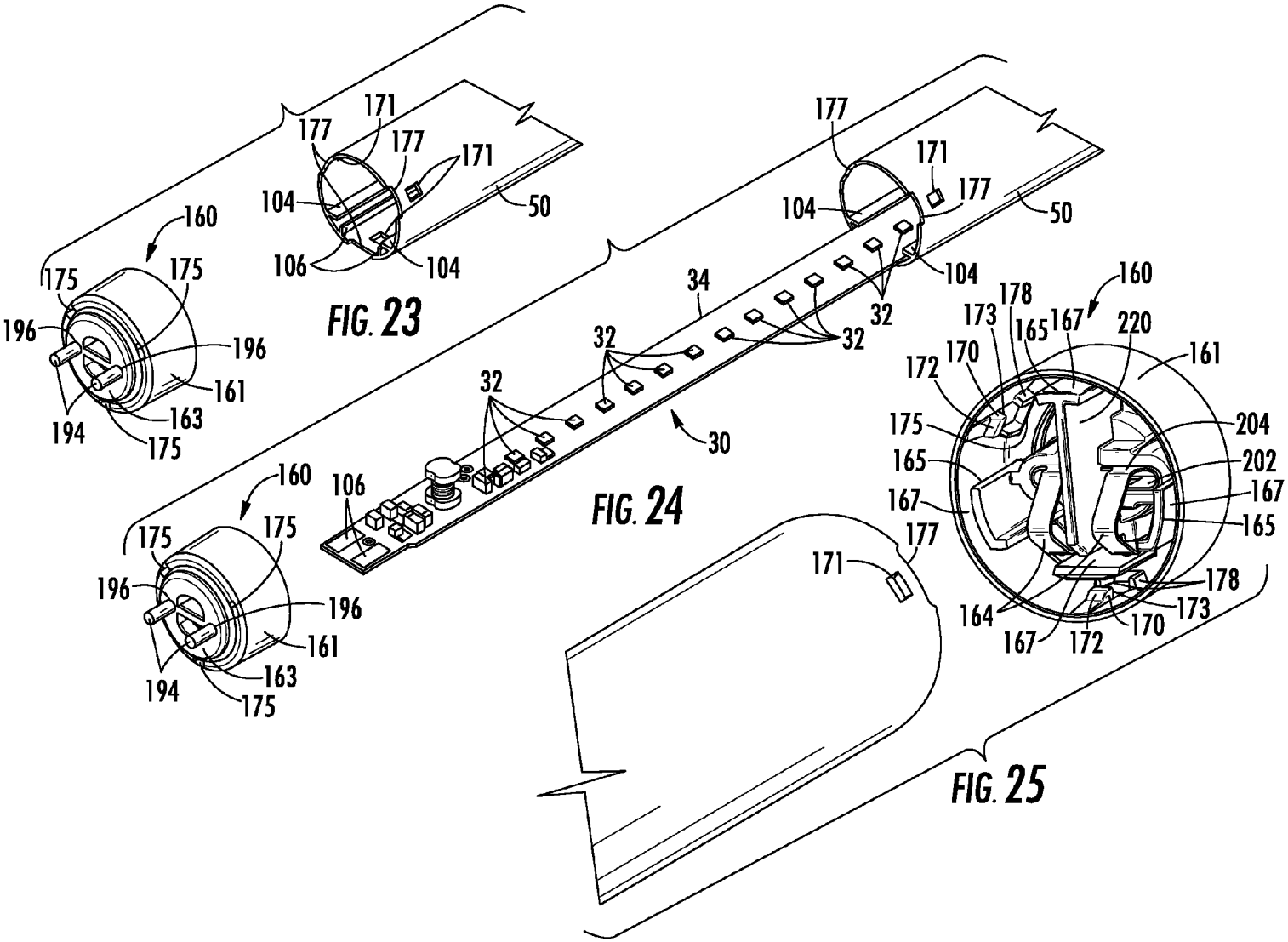
FIG. 23 is a partial exploded perspective view of the enclosure and end cap of the LED lamp of FIG. 19.
FIG. 24 is an exploded view of the lamp of FIG. 19.
FIG. 25 is another partial exploded perspective view of the enclosure and end cap of the LED lamp of FIG. 19.
Figure 32:
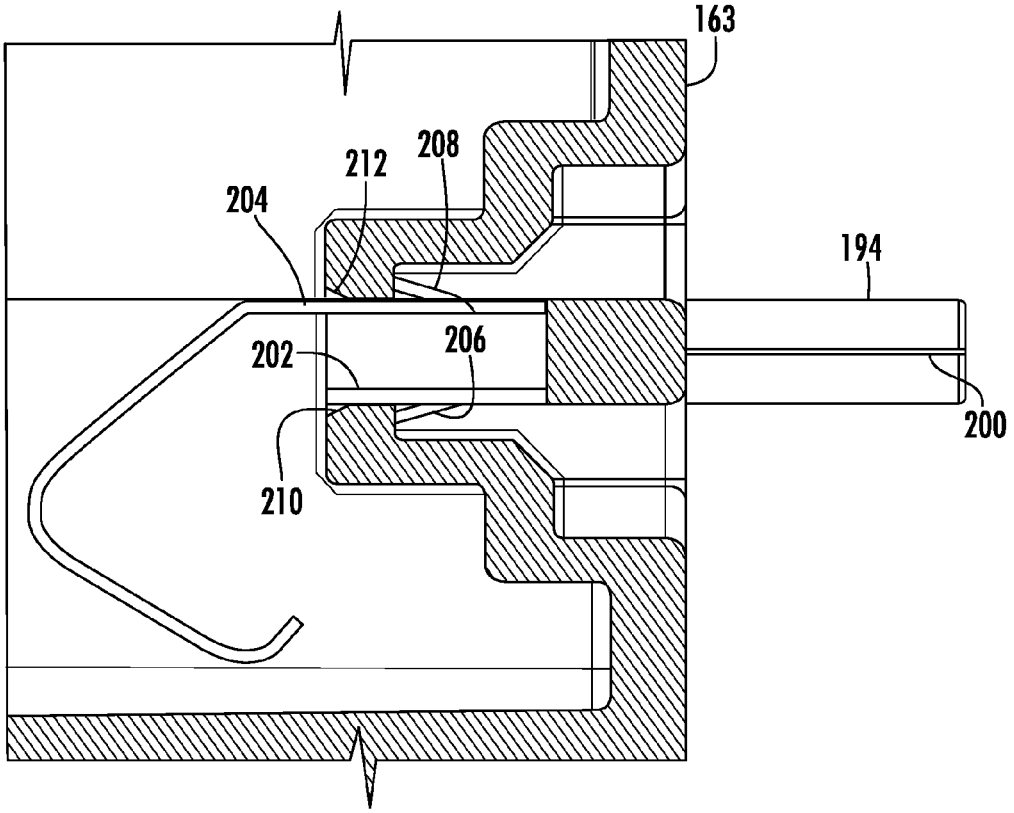
FIG. 32 is a section view of the end cap showing the engagement of the pin and end cap in the LED lamp of FIG. 19.

To assemble the end cap 160 the pin 194 is inserted into one of the holes 196 formed in the end wall of the end cap 160 from the inside of the end cap 160. Referring to FIGS. 20 and 32, a pair of spaced walls 210, 212 are formed on the interior of end wall 163 where the walls are spaced to closely receive the flanges 202, 204. The distance between the walls 210, 212 is approximately the same as the distance between the outer surfaces of flanges 202, 204. As a result, as the pin/conductor assembly is inserted into the end cap the tangs 206, 208 contact the walls 210, 212 such that the tangs 206, 208 and/or flanges 202, 204 are compressed towards one another. The tangs 206, 208 are formed at an angle relative to the insertion direction such that contact of the sloping surfaces of the tangs with the walls 210, 212 forces the tangs 206, 208 and flanges 202, 204 toward one another to allow the tangs to pass the walls 210, 212. When the distal ends of the tangs 206, 208 reach the ends of the walls 210, 212, the tangs 206, 208 return toward their undeformed state such that the tangs 206, 208 extend beyond and abut the walls 210, 212. The engagement of the tangs 206, 208 with the walls 210, 212 prevents the pin/conductor assemblies from being removed from the end caps 160.

The conductors 164 comprise resilient members that are biased into engagement with contacts 66 on the LED board 34 as shown in FIG. 43. The free ends of the conductors 164 extend into the internal space of the end cap 160 where the conductors 164 make contact with electrical contacts 106 on the LED board 34. The conductors 164 are configured and supported such that the conductors 164 are resiliently deformed by engagement with the LED board 34 as the LED board is inserted into the end caps 160 such that the free ends of the conductors 164 are biased into engagement with the contacts 106. The electrical coupling between the conductors 164 and the contacts 106 is referred to herein as "contact coupling" where the electrical connection is made by the contact of the conductors 164 with the contacts 106 under pressure without the use of solder or wires. An insulator 220 may be provided between the conductors 64 to electrically insulate the conductors from one another. An electrical path is created between the pins 194 and the LED board 34 to provide both sides of critical current to the LED assembly.

A support surface 167 is positioned underneath conductors 164 to support the LED board 34 when the end cap 160 is inserted over the enclosure 50. The support surface 167 supports the end of the LED board 34 to ensure that the LED board is properly positioned and supported to make the contact coupling with the conductors 164 to ensure a good electrical connection.

In another embodiment the pins 194 may be electrically coupled to the LED board 34 using conductors that are soldered or otherwise fixed to the LED board contacts 106 and that are electrically coupled to the pins 194. In one embodiment the conductors may comprise wires, ribbons or the like. The conductors are electrically coupled to the pins 194 and may be soldered or otherwise electrically coupled to the electrical contacts 106 on the LED board 34. After the conductors are electrically connected to the LED board 34, the end caps 160 may be attached to the enclosure 50 to complete the lamp.

The end cap 160 comprises an internal chamber defined by side wall 161 and an end wall 163 configured to closely receive the enclosure 50. In one embodiment internal walls 165 extends from the end wall 163 and are located inside of the side wall 161 to create spaces 167 for receiving the enclosure 50.

In one embodiment, a snap-fit connection may be used to secure the end caps 160 to the enclosure 50. In one embodiment the end cap 160 is provided with tangs 170 on the interior of side walls 61 that engage detents 171 formed on the enclosure 50. The tangs 170 on the end cap 160 engage the detents 171 on the enclosure 50 when the enclosure is inserted into the end cap 160. The end caps 160 and/or the enclosure 50 may be slightly resiliently deformable such that as the enclosure 50 is inserted into the end cap 160 the enclosure and/or the end caps deform to allow a snap-fit connection to be made. The detents 171 may comprise apertures that extend through the enclosure or the detents 171 may comprise recesses formed in the enclosure. Each of the tangs 170 are provided with an angled facing surface 172 that engages the edge of the enclosure 50 to slightly and gradually deform the enclosure as the enclosure is slid into the end cap 160. The back surface 173 of the tangs is formed at a substantially right angle relative to the side wall 161 such that when the tang 170 is inserted into the detents 171 the end cap 161 cannot be removed from the enclosure 50 during use of the lamp. The end caps 161 may be removed from the enclosure 50 during the manufacturing process if necessary by inserting a specialized pry tool into the apertures 175 to deform the enclosure 50 and disengage the tang 170 from the detent 171. While the end caps 161 may be removed from the enclosure during the manufacturing process, the end caps are permanently secured to the enclosure using the snap-fit connection such that during use of the lamp the end caps cannot be removed from the enclosure.

In the illustrated embodiment three pairs of mating tangs 170 and detents 171 are provided evenly spaced about the perimeter of the end cap 161 and enclosure 50. A greater or fewer number of the snap-fit connectors may be used. Other arrangements of a snap-fit connector may be used. For example the tangs may be provided on the outer surfaces of the inner walls 165 such that the tangs engage the detents from the inside of the enclosure 50 rather than from the outside of the enclosure. Alternatively, these components may be reversed and the end cap 160 may be provided with the detents and the enclosure 50 may be provided with the tangs.

In some embodiments the length of the lamp must be tightly controlled in order to meet industry standards and to fit into existing light fixtures. To assemble the lamp the enclosure 50 is extruded in a relatively long length. The enclosure 50 is then cut to a desired length where the length of the enclosure with the end caps mounted thereon creates a lamp that falls within the accepted tolerances for the length of the lamp. The end caps 160 are inserted over the ends of the enclosure 50 to complete the lamp. In order to accommodate variations in the length of the enclosure 50 the detents 171 are formed in the enclosure 50 a fixed distance from one another such that when the end caps 160 are inserted onto the enclosure 50 the spacing between the end caps 160 corresponds to the desired length of the lamp. Notches 177 may be formed in the ends of the enclosure 50 that are aligned with the apertures 171. The notches 177 receive spaced flanges 178 formed on the end caps 160 to position the end caps 160 relative to the enclosure 50. The notches 177 are dimensioned such that the notches 177 may receive the flanges 178 with enough longitudinal spacing that the notches 177 may accommodate small differences in the length of the enclosure 50 without affecting the overall length of the lamp.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

an elongated at least partially optically transmissive enclosure having a first end and a second end;

at least one LED in the enclosure operable to emit light through the enclosure when energized through an electrical path;

the at least one LED being mounted on an LED board, the enclosure comprising at least a first support structure for supporting the LED board, the support structure being formed as one-piece with the enclosure and being formed of an optical material; and an end cap secured to the enclosure using a snap-fit connection;

wherein the end cap supports a first pin and a second pin, the first pin and the second pin being in the electrical path; and a first conductor connecting the first pin to the LED board using a first contact coupling, the first conductor being formed as one piece with the first pin; and a second conductor connecting the second in to the LED board using a second contact coupling, the second conductor being formed as one piece with the second pin, the first pin and the first conductor being retained in the first end cap by a deformable first tang and the second pin and the second conductor being retained in the first end cap by a deformable second tang.

2. The lamp of claim 1 wherein the snap-fit connection comprises a tang on one of the end cap and the enclosure that mates with a detent on the other of the end cap and enclosure.

3. The lamp of claim 2 wherein the tang is formed on the end cap and the detent is formed on the enclosure.

4. The lamp of claim 2 wherein the detent comprises an aperture that extends through the enclosure.

5. The lamp of claim 2 wherein the tang comprises an angled camming surface that deforms the enclosure when the enclosure is inserted into the end cap.

6. The lamp of claim 2 wherein a plurality of tangs engage a plurality of detents.

7. The lamp of claim 1 wherein the first conductor is resilient.

8. The lamp of claim 1 wherein the LED board comprises a first contact and the first conductor is deformed to create a bias force between the first conductor and the first contact.

9. The lamp of claim 8 wherein a support surface is positioned adjacent the LED board to a side of the LED board opposite the first conductor.

10. The lamp of claim 1 wherein the first pin and the first conductor are made of a first piece of electrically conductive material that is bent to form the first pin and the first conductor.

11. The lamp of claim 1 wherein the first pin and first conductor and the second pin and the second conductor are made of stainless steel.

12. The lamp of claim 1 wherein the first pin and the second pin are hollow.

13. The lamp of claim 1 wherein the enclosure and the support structure are formed of the same optically transmissive material.

14. The lamp of claim 1 wherein the support structure extends for substantially the length of the enclosure.

15. The lamp of claim 1 wherein the support structure comprises a first channel and a second channel for receiving opposite longitudinal edges of the LED board.

16. The lamp of claim 1 wherein a portion of the enclosure extends behind the at least one LED.

17. A lamp comprising:

a plastic, elongated at least partially optically transmissive tubular enclosure;

at least one LED in the enclosure operable to emit light through the enclosure when energized through an electrical path; and a first end cap and a second end cap snap-fit onto the enclosure, the first end cap supporting a first pin and the second end cap supporting a second pin, the first pin and the second pin being coupled to the electrical path;

a first conductor connecting the first pin to the LED board using a first contact coupling; and a second conductor connecting the second in to the LED board using a second contact coupling;

the first pin and the first conductor being retained in the first end cap by a deformable first tang and the second pin and the second conductor being retained in the second end cap by a deformable second tang.

18. A lamp comprising:

an elongated at least partially optically transmissive enclosure having a first end and a second end;

at least one LED in the enclosure operable to emit light through the enclosure when energized through an electrical path;

the at least one LED being mounted on an LED board, the enclosure comprising at least a first support structure for supporting the LED board, the support structure being formed as one-piece with the enclosure and being formed of a low thermally conductive material;

an end cap snap-fit onto the enclosure by a deformable tang on one of the end cap and the enclosure that engages an aperture on the other one of the end cap and the enclosure, the end cap supporting a first pin and a second pin in the electrical path;

a first conductor formed integrally with the first pin and connecting the first pin to the LED board using a first contact coupling, and a second conductor formed integrally with the second pin and connecting the second pin to the LED board using a second contact coupling;

each of the first pin and the first conductor and the second pin and the second conductor being retained in the end cap by a snap-fit connector comprising a deformable member that engages the end cap.

19. The lamp of claim 18 wherein the enclosure and the support structure are formed of the same low thermally conductive material.

20. The lamp of claim 18 wherein the support structure extends for substantially the length of the enclosure.

21. The lamp of claim 18 wherein the support member comprises a channel for receiving the LED board.

22. The lamp of claim 18 wherein the enclosure and the support structure are formed of plastic.

* * * * *

UNITED STATES PATENT AND TRADEMARK OFFICE

CERTIFICATE OF CORRECTION

PATENT NO. : 9,328,874 B2
APPLICATION NO. : 14/319066
DATED : May 3, 2016
INVENTOR(S) : Randolph C. Demuynck et al.

It is certified that error appears in the above-identified patent and that said Letters Patent is hereby corrected as shown below:

IN THE CLAIMS:

In column 22, claim 1, please change line 4 to:

pin; and a second conductor connecting the second pin to

In column 22, claim 17, please change line 62 to:

connecting the second pin to the LED board using a

Signed and Sealed this
Twelfth Day of July, 2016

Michelle K. Lee

Michelle K. Lee
*Director of the United States Patent and Trademark Office*